US010518120B2

(12) United States Patent
Pai et al.

(10) Patent No.: US 10,518,120 B2
(45) Date of Patent: Dec. 31, 2019

(54) FIRE EXTINGUISHING COMPOSITIONS

(71) Applicant: HYDRANT INTERNATIONAL TRADING CO., LTD., Changhai (TW)

(72) Inventors: Chien Nan Pai, Changhua (TW); I-Hwa Midey Chang-Mateu, Ambler, PA (US)

(73) Assignee: Hydra$^{NT}$ International Trading Co., Ltd., Changhai (TW)

( * ) Notice: Subject to any disclaimer, the term of this patent is extended or adjusted under 35 U.S.C. 154(b) by 205 days.

(21) Appl. No.: 15/119,670

(22) PCT Filed: Feb. 17, 2015

(86) PCT No.: PCT/US2015/016227
§ 371 (c)(1),
(2) Date: Aug. 17, 2016

(87) PCT Pub. No.: WO2015/126854
PCT Pub. Date: Aug. 27, 2015

(65) Prior Publication Data

US 2017/0056698 A1 Mar. 2, 2017

Related U.S. Application Data

(60) Provisional application No. 61/941,396, filed on Feb. 18, 2014.

(51) Int. Cl.
*A62D 1/00* (2006.01)

(52) U.S. Cl.
CPC ..... *A62D 1/0042* (2013.01)

(58) Field of Classification Search
None
See application file for complete search history.

(56) References Cited

U.S. PATENT DOCUMENTS 4,060,489 A * 11/1977 Chiesa, Jr. ..... A62C 99/0036 252/2
4,149,599 A * 4/1979 Chiesa, Jr. ..... A62D 1/0085 169/46
5,039,451 A * 8/1991 Phillips ..... C11D 1/37 510/535
5,085,786 A * 2/1992 Alm ..... A62D 1/0085 252/8.05
5,585,028 A 12/1996 Berger
5,616,273 A * 4/1997 Clark ..... A62D 1/0085 252/2
6,376,455 B1 * 4/2002 Friedli ..... A61K 8/416 510/515
2008/0196908 A1 8/2008 Schaefer
2008/0305976 A1 * 12/2008 Turin ..... C07C 41/46 510/102
2009/0072182 A1 3/2009 Berger
2009/0126948 A1 5/2009 Desanto
2010/0181084 A1 7/2010 Carmo
2013/0264509 A1 10/2013 Shalev et al.
2013/0313465 A1 11/2013 Podella et al.

FOREIGN PATENT DOCUMENTS

| | | |
|---|---|---|
| CN | 1103605 | 6/1995 |
| CN | 102886114 | 1/2013 |
| CN | 103007478 | 4/2013 |
| WO | 1999029373 | 6/1999 |
| WO | 2003049813 | 6/2003 |

OTHER PUBLICATIONS

Taiwan Patent Office Search Report dated Sep. 27, 2018, for Application No. 104105751.
International Search Report and Written Opinion for PCT/US2015/016227 dated May 1, 2015.

* cited by examiner

*Primary Examiner* — Joseph D Anthony
(74) *Attorney, Agent, or Firm* — BioMed IP

(57) ABSTRACT

A fire extinguishing concentrate contains water, a first surfactant which is an anionic surfactant, a second surfactant which is an amphoteric surfactant, a third surfactant which is selected from an anionic surfactant and an amphoteric surfactant, the third surfactant being different from the first and second surfactants, and water, along with optional ingredients. The concentrate may be combined with water to provide a fire extinguishing composition that may be applied to a fire for a time and in an amount effective to extinguish the fire.

11 Claims, No Drawings

FIRE EXTINGUISHING COMPOSITIONS

CROSS-REFERENCE TO RELATED APPLICATION

This application is a national phase application under 35 U.S.C. § 371 of International Application No. PCT/US2015/0016227, filed Feb. 17, 2015, which claims the benefit under 35 U.S.C. § 119(e) of U.S. Provisional Patent Application No. 61/941,396 filed Feb. 18, 2014, each application is incorporated herein by reference in its entirety.

FIELD OF THE INVENTION

The present invention relates generally to fire extinguishing compositions, concentrates thereof, and methods of making using the compositions.

BACKGROUND

Uncontrolled fires are one of the most dangerous and undesirable events that people face. There is a need for fire extinguishing compositions that are effective in quenching a fire within a short period of time. It is highly desirable that those compositions are non-toxic to the environment, and it is certainly desirable that they are not harmful to people if they come into contact with people. Likewise, it is highly desirable that the combustion products of those compositions are non-toxic to the environment and not harmful to people and animal life generally. The present invention is directed towards fulfilling these and related needs associated with extinguishing an uncontrolled fire.

SUMMARY

Briefly stated, the present disclosure provide fire extinguishing concentrates, fire extinguishing compositions which are water-diluted forms of the concentrates, methods of making the concentrates and the compositions, and methods of using the concentrates and the compositions in order to extinguish a fire.

In one embodiment, the present disclosure provides a composition comprising water and solids, the solids comprising a first surfactant selected from amphoteric surfactants, a second surfactant selected from anionic surfactants, and a third surfactant selected from an amphoteric and an anionic surfactant, the third surfactant being different from the first and second surfactants. The composition may be used directly for extinguishing a fire, or it may be prepared in a concentrated form which may be diluted as needed to provide a fire extinguishing composition. The composition or concentrate thereof may contain one or more optional ingredients. Exemplary optional ingredients are an inorganic salt, an organic solvent, and a thickening agent.

In another embodiment, the present disclosure provides a composition comprising water and solids, the solids comprising a first surfactant selected from amphoteric surfactants, a second surfactant selected from anionic surfactants. The composition may be used directly for extinguishing a fire, or it may be prepared in a concentrated form which may be diluted as needed to provide a fire extinguishing composition. The composition or concentrate thereof may contain one or more optional ingredients. Exemplary optional ingredients are an inorganic salt, an organic solvent, and a thickening agent.

In one embodiment, the present disclosure provides a method of making a fire extinguishing concentrate by a batch method. In this embodiment, a fire extinguishing concentrated composition is prepared by a method comprising adding to a container, hot water, an anionic surfactant, an amphoteric surfactant, and optionally a third surfactant selected from an anionic surfactant and an amphoteric surfactant, where the third surfactant is different from the already added anionic and amphoteric surfactants. Additional optional ingredients include an inorganic salt, an organic solvent, and thickening agent; wherein after an addition of a component to the container, a resulting mixture is stirred until it reaches a completely or nearly homogeneous state, for example, for about 30 minutes with minimal foam generation before addition of a next component.

For example, the present invention provides a process for making a fire extinguishing concentrated composition comprising:

a) heating water to about 70-80° C. to provide hot water;
b) adding an anionic surfactant to the hot water;
c) adding an amphoteric surfactant to the mixture of step b);
d) adding hot water to the mixture of step c);
e) optionally adding a third surfactant to the mixture of step d), the third surfactant selected from an anionic surfactant and an amphoteric surfactant, the third surfactant being different from the anionic surfactant and the amphoteric surfactant already present in the mixture;
f) adding inorganic salt to the mixture of step e);
g) cooling the mixture of step f) to ambient temperature; and
h) adding thickening agent to the mixture of step f);

wherein after an addition of a component, a resulting mixture is stirred for a time effective to achieve a homogeneous or nearly homogeneous mixture, typically about 30 minutes, with minimal foam generation before addition of a next component.

In one embodiment, the present disclosure provides a method of making a fire extinguishing concentrate by a continuous method. In this embodiment, a fire extinguishing concentrate is prepared by providing a continuous reactor, charging water to the continuous reactor, adding to the water in the continuous reactor a) an anionic surfactant, b) an amphoteric surfactant, and optionally c) a third surfactant selected from an anionic surfactant and a cationic surfactant, the third surfactant being different from the anionic and amphoteric surfactant already charged to the reactor; and mixing components a), b) and optionally c) to provide a homogeneous mixture. Optionally, the water in the continuous reactor is maintained at a temperature in excess of 50° C. Optionally, additional ingredients are added to the formulation, such as organic solvent, inorganic salt, and thickening agent. Optionally, a mixer selected from an inline mixer and a static mixer is present in the continuous reactor.

In one embodiment, the present disclosure provides a method for forming a fire extinguishing composition from the fire extinguishing concentrate. According to this embodiment, water and concentrate are combined in a suitable water:concentrate ratio, and the two components are mixed together to form the fire extinguishing composition. The mixing may optionally be achieved by means of a Venturi tube, wherein a restriction in the diameter of tubing through which water flows, is used to draw concentrate from a reservoir into the water to provide the fire extinguishing composition.

In one embodiment, the present disclosure provides a method for extinguishing a fire, where the method comprises applying an effective amount of the fire extinguishing composition of the present disclosure onto a fire, for a time effective to extinguish the fire.

The details of one or more embodiments are set forth in the description below. The features illustrated or described in connection with one exemplary embodiment may be combined with the features of other embodiments. Other features, objects and advantages will be apparent from the description and the claims. In addition, the disclosures of all patents and patent applications referenced herein are incorporated by reference in their entirety.

DETAILED DESCRIPTION OF THE INVENTION

In one aspect, the present disclosure provides a fire extinguishing composition, in both concentrated and diluted (ready to use) form. In another aspect, the present disclosure provides a method of forming a fire extinguishing composition in a concentrated form and then diluting that concentrated composition to a dilute form. In another aspect, the present disclosure provides a method of using the compositions as a means to extinguish a fire.

Briefly stated, the composition contains at least two active ingredients, and optionally contains at least three active ingredients, in addition to carrier. Those ingredients are an amphoteric surfactant and an anionic surfactant, and when a third surfactant is present, that third surfactant is selected from an anionic surfactant and an amphoteric surfactant which is not identical to either the first (the amphoteric) or second (the anionic) surfactant. The composition may contain one or more optional ingredients, e.g., an inorganic salt and a thickening agent. The carrier is water, optionally in combination with small amounts of organic solvent(s). In one aspect, the fire extinguishing composition contains no carbon-halogen bonds, and thus is more environmentally friendly than an alternative composition that contains one or more components having such bonds.

It is noted that, as used in this specification and the intended claims, the singular form "a," "an," and "the" include plural referents unless the context clearly dictates otherwise. Thus, for example, reference to "an amphoteric surfactant" includes a single amphoteric surfactant as well as one or more of the same or different amphoteric surfactants.

Components

Amphoteric Surfactant

The fire extinguishing compositions of the present disclosure include at least one, and optionally include more than one, amphoteric surfactant. As used herein, an amphoteric surfactant is a molecule that contains both a positively charged atom and a negatively charged atom. Surfactant molecules may include polymeric components, and may also include a counterion(s) such as sodium and ammonium, however the counterion is not considered to be one of the positively or negatively charged atoms that qualifies the molecule as being an amphoteric surfactant.

The positively charged atom may be, for example, a nitrogen atom which provides, e.g., an ammonium group, or may be a sulfur atom which provides, e.g., a sulfonium group. The presence of a positive charge on a particular atom may be a function of the pH to which the molecule is exposed. In other words, the amphoteric surfactant of the present disclosure need not have a positively charged atom and a negatively charged atom at every pH of the surrounding solution, but may have these charged atoms only within a pH range. For example, when the molecule has a nitrogen atom that bears a positive charge, that charge may only be present when the pH of the surrounding solution (an aqueous solution) is sufficiently low that the nitrogen atom becomes protonated. This occurs, for example, when the nitrogen atom is part of a primary, secondary or tertiary amine. Alternatively, the nitrogen atom may be part of a quaternary ammonium ion which maintains its positive charge regardless of the pH of the surrounding solution.

The negatively charged atom may be, for example, an oxygen atom which may be part of a recognized functional group such as a carboxylate, sulfate, sulfonate, or phosphate group. As with the positive charge, the presence of a negative charge on a particular atom may be a function of the pH to which the molecule is exposed. In other words, the amphoteric surfactant of the present disclosure need not have a negatively charged atom and a positively charged atom at every pH of the surrounding solution, but may have these charged atoms only within a pH range. For example, when the molecule has an oxygen atom that bears a negative charge, that charge may only be present when the pH of the surrounding solution (an aqueous solution) is sufficiently high that the oxygen atom becomes deprotonated. This may occur, for example, when the oxygen atom is part of, e.g., a carboxylic acid group, where only the carboxylate form of the carboxylic acid group has a negatively charged oxygen atom while the corresponding carboxylic acid form has a neutral oxygen atom.

In summary, the amphoteric surfactant need not have both a positively charged atom and a negatively charged atom throughout the entire possible pH range of the surrounding solution, but will have these two charged atoms at some pH range, which is sometimes referred to in the art as the isoelectric pH range. When the amphoteric surfactant has both a positively and negatively charged atom, the surfactant may be said to be in its zwitterionic form. When a chemical structure of an amphoteric surfactant is provided herein, the term X may be used to refer to the counterion which may be associated with the positively or negatively charged atom within the isoelectric pH range. Exemplary cationic counterions are sodium and ammonium. Exemplary anionic counterions are chloride and phosphate. Noteworthy is that either the positive or negative charge may be delocalized over a plurality of atoms. For example, when the negative charge is on an oxygen atom, and that oxygen atom is part of a carboxylate group, the negative charge is delocalized over both of the oxygen atoms of the carboxylate group.

In addition, and as with all surfactants, the amphoteric surfactant will have both a lipophilic (a.k.a., hydrophobic) region and lipophobic (a.k.a., hydrophilic) region. The lipophilic region may be referred to as the fatty region. The fatty region may be composed of the hydrocarbon portion which is present in a naturally occurring fatty acid, fatty alcohol, fatty amine or the like, however it may alternatively be formed synthetically, i.e., it may be a synthetically produced fragment such as polyethylene, polypropylene, poly(propylene oxide), etc. As used herein, and when describing a class of amphoteric surfactant, the term "R" will be used to refer to a fatty region of the molecule. In various embodiments, R designates a medium or long chain fatty group, such as: a $C_6$-$C_{24}$ fragment, i.e., a molecular fragment having at least 6 and up to 24 carbon atoms, and optionally any other atoms, e.g., hydrogen, halogen (e.g., F, Cl, Br), nitrogen, and oxygen; $C_6$-$C_{24}$ hydrocarbon, i.e., a molecular fragment having 6-24 carbon atoms and sufficient hydrogen atoms to complete the valencies of the carbon atoms; $C_8$-$C_{22}$ fragment; $C_8$-$C_{22}$ hydrocarbon; $C_{10}$-$C_{20}$ fragment; $C_{10}$-$C_{20}$ hydrocarbon; $C_{12}$-$C_{18}$ fragment; and $C_{12}$-$C_{18}$ hydrocarbon. In various embodiments, R has at least 6, or at least 8, or at least 10, or at least 12, or at least 14, or at least 16 carbon atoms. In various embodiments, R has no more than 30, or no more than 26, or no more than 24, or not more than 22, or no more than 20, or no more than 18 carbon atoms. The term R may represent an alkyl group, where the term alkyl refers to linear, branched or cyclic saturated hydrocarbon groups, generally having any of the number of carbon atom ranges specified above (e.g., $C_6$-$C_{24}$ refers to an alkyl group having 6 to 24 carbon atoms). Examples of alkyl groups include 3-methylhexyl, 2,2-dimethylpentyl, 2,3-dimethylpentyl, caprylic, capric, lauric, myristic, palmitic, stearic, oleic, linoleic, linolenic, and behenic.

The following several paragraphs provide exemplary specific surfactant categories and examples of specific amphoteric surfactants that may be incorporated into the fire extinguishing compositions of the present disclosure. It should be noted that the categories are not mutually exclusive in that a specific amphoteric surfactant may fall into more than one category, i.e., two categories may overlap in terms of the surfactants that are encompassed within a category. There is a diverse nomenclature used in the surfactant art to categorize and recognize classes of amphoteric surfactants specifically, and surfactants in general, where that nomenclature often does not provide for mutually exclusive categories of surfactants. Nevertheless, the following provides for amphoteric surfactants useful in the present disclosure. For convenience, the surfactant may be identified by reference only to its charged portion. For instance, the amphoteric surfactant may be referred to as a betaine, or a betaine surfactant in order to indicate that the amphoteric surfactant contains a betaine group. As another example, when the amphoteric surfactant comprises a hydroxysultaine group, such a surfactant may be referred to either as a hydroxysultaine surfactant, or when the context permits, even more simply as a hydroxysultaine. Alternatively, it may be said that the amphoteric surfactant comprises a specifically identified charged group such as a betaine or betaine group, a hydroxysultaine group, an amine oxide group, etc.

In some of the following chemical structures the term "L" is used to refer to a linking group. A linking group is a short chain of atoms that links together two noted functional groups present in the amphoteric surfactant. In one embodiment, L is methylene, i.e., —$CH_2$—. In one embodiment, L is ethylene, i.e., —$CH_2CH_2$—. In one embodiment, L is propylene, i.e., —$CH_2CH_2CH_2$—. The linking group may include a substituent on an alkylene chain, where the substituent may be, e.g., halogen, hydroxyl or short-chain (about $C_1$-$C_4$) alkyl. In one embodiment, L is hydroxyl substituted propylene, e.g., —$CH_2CH(OH)CH_2$—. In another embodiment, L is methyl substituted methylene, e.g., —$CH(CH_3)$—. In one embodiment, L is methylene, ethylene or propylene, each optionally substituted with hydroxyl. In one embodiment, L is dimethylether, i.e., —$CH_2$—O—$CH_2$—. In one embodiment, L is a chain of 1-5 atoms selected from carbon and oxygen, where the chain is optionally substituted with hydroxyl or halide.

Any of the following terms may be used to specifically recite an "amphoteric surfactant" to thereby provide a selection of amphoteric surfactants that are useful in an embodiment of the present disclosure: alkyl amidopropyl betaine, alkyl amine oxide, alkyl amphoacetates, alkyl betaine, alkyl carboxyglycinate, alkyl glycinate, alkyl sulphobetaine, sultaine, alkyl amphopropionates, alkylamphoglycinates, alkyl amidopropyl hydroxysultaines, acyl taurate and acyl glutamate. Each of these terms is known in the art, and many of these terms are described below.

In one embodiment, the amphoteric surfactant is a betaine surfactant, which means that the surfactant includes a betaine group. The betaine surfactant may be an alkyl amido propyl betaine which may be represented by the chemical structure $CH_3$—$(CH_2)_n$—CONH—$CH_2CH_2CH_2$—$N(CH_3)_2$—$CH_2$—COOX when the alkyl group is a linear alkyl group. More generally, an amido propyl betaine may be represented by the chemical structure R—CONH—$CH_2CH_2CH_2$—$N(CH_3)_2$—$CH_2$—COOX. These are both examples of alkyl amido betaines.

In one embodiment, the amphoteric surfactant is an alkyl amido sulfobetaine which may be represented by the chemical structure R—CONH-L-$N(CH_3)_2$—$(CH_2)_m$—$SO_2OX$ wherein L is propylene. A subset of this class is the alkylbenzene dimethyl ammonium propanesulfonates obtained by quaternization of the alkylbenzene dimethyl amine with propanesulfone. Again, the propylene linking group L may be substituted, e.g., with a hydroxyl group (which provides for 2-hydroxy-1-propanesulfonate derivatives) to provide another amphoteric surfactant suitable for use in the present compositions.

In one embodiment, the amphoteric surfactant is an alkyl amino acid amphoteric surfactant which may be represented by the chemical structure R—NH-L-COOX, where R and L are defined above. For example, R may be derived from coconut oil, L may be ethylene and X may be sodium ion.

In one embodiment, the amphoteric surfactant is an alkyl betaine amphoteric surfactant which may be represented by the chemical structure R—$N(CH_3)_2$-L-COOX where R is an alkyl group and L is a linking group. As with other amphoteric surfactants disclosed herein, the R group may be a fatty group rather than being limited to an alkyl group, however in one embodiment the R represents an alkyl group. As mentioned previously, the linking group may be, and in one embodiment is a methylene group. However alkyl betaines also include the α-(N,N,N-trialkyl ammonium) alkanoates, having the structure $R^1$—$N(R^2)(R^3)$—$C(R^4)H$—COOX where L is an alkyl substituted methylene group. Various alternative and sometimes more specific names are used to name alkyl betaines, for example, N-alkyl-N,N-dimethylglycine; N-alkyl-N,N-dimethyl-N-carboxymethyl ammonium betaine; alkyl-dimethyl ammonium acetate or alkyl-dimethyl ammonium ethanoate. The Cosmetic, Toiletry and Fragrance Association, Inc. (CTFA) uses the name alkylbetaine for these products.

In one embodiment, the amphoteric surfactant is an alkyl imidazoline derived amphoteric surfactant which may be represented by the chemical structure R—CONH-L-N$(CH_2CH_2OH)CH_2COONa$. In another embodiment, the alkyl imidazoline derived amphoteric surfactant is a diacid which may be represented by the chemical structure R—$CON(CH_2CH_2OH)$-L-$N(CH_2COONa)_2$. In either of these embodiments, the linker L is optionally ethylene.

In one embodiment, the amphoteric surfactant is an alkyl imino diacid amphoteric surfactant which may be represented by the chemical structure R—$N(CH_2CH_2COONa)_2$. In alternative embodiments, the alkyl imino diacid amphoteric surfactant is represented by the chemical structure R—$N(CH_2CH_2CH_2COONa)_2$ or R—$N(CH_2COONa)_2$.

In one embodiment, the amphoteric surfactant is an alkyl sulfobetaine amphoteric surfactant. The chemical structure of an alkyl sulfobetaine may be represented as R—$N(CH_3)_2$-L-$SO_2OX$ (also sometimes represented as -L-$SO_3X$) where R is alkyl and L is methylene. The following are exemplary of specific alkylsulfobetaines that may be used in the practice of the present invention: caprylyl sulfobetaine, hexadecyl sulfobetaine, lauryl sulfobetaine, myristyl sulfobetaine, n-octyl sulfobetaine, palmityl sulfobetaine, tetradecyl sulfobetaine, In one embodiment, the amphoteric surfactant is an alkyl sultaine, which is a term favored by CTFA. Alkyl sultaine are sulfobetaine amphoteric surfactants that include the propanesulfonate group, i.e., L-$SO_3X$ wherein L is propylene. An alkyl sultaines has the chemical structure R—N$(CH_3)_2$—$CH_2CH_2CH_2$—$SO_2OX$.

In one embodiment, the amphoteric surfactants is an amido propyl betaine which may be represented by the chemical structure R(C═O)—NH—$(CH_2)_3$—N$(CH_3)_2$—$CH_2COOX$. This class of amidopropyl betaine may also be referred to as an alkyl amido propyl betaine since R may be alkyl group. An alkylamidopropyl betaine surfactant is typically synthesized by reaction of a fatty acid, for example the fatty acid from natural oils such as coconut oil, and 3,3-dimethylaminopropylamine to provide an amidopropyl dimethylamine intermediate, which in turn is reacted with sodium monochloroacetic acid to provide the corresponding betaine. A betaine surfactant is commonly named after the source of the fatty acid used in its preparation, e.g., coconut oil provides for cocamidopropyl betaine, and isostearic acid provides for isostearmidopropylbetaine. Many alkylamidopropyl betaine surfactants suitable for use in the present invention are commercially available in solid and solution form, and may be purchased from various suppliers.

The following are specific exemplary amidopropyl betaines that may be used in the practice of the present invention: almondamidopropyl betaine, apricotamidopropyl betaine, avocadamidopropyl betaine, babassuamidopropyl betaine, behenamidopropyl betaine, canolamidopropyl betaine, capryl/capramidopropyl betaine (formed from a mixture of caprylic acid and capric acid), coco/oleamidopropyl betaine, coco/sunfloweramidopropyl betaine (formed from a blend of coconut and sunflower seed oils), cupuassuamidopropyl betaine (formed from the pulp of the cupuassu tree), isostearamidopropyl betaine, lauramidopropyl betaine, meadowfoamamidopropyl betaine (formed from meadowfoam seed oil), milkamidopropyl betaine, minkamidopropyl betaine (formed from mink oil), myristamidopropyl betaine, oatamidopropyl betaine (formed from *Avena sativa* (oal) kernel oil), oleamidopropyl betaine, olivamidopropyl betaine, palmamidopropyl betaine (formed from palm oil), palmitamidopropyl betaine, palm kernelamidopropyl betaine (formed from palm kernel oil), ricinoleamidopropyl betaine, sesamidopropyl betaine, shea butteramidopropyl betaine (formed from Butyrospermum Parkii (shea butter)), soyamidopropyl betaine, stearamidopropyl betaine, tallowamidopropyl betaine, undecylenamidopropyl betaine, and wheat germamidopropyl betaine (formed from the oil in wheat germ).

In one embodiment, the amphoteric surfactant is an amine oxide amphoteric surfactant which may be represented by the chemical structure R—N$(CH_3)_2$—O— where R is a lipophilic group. An exemplary R group is a lipophilic alkyl group, where amine oxide surfactants having an alkyl group for R are commonly known as alkyl amino oxides. Exemplary alkyl groups are caprylic, capric, lauric, myristic, palmitic, stearic, oleic, linoleic, linolenic, and behenic. Exemplary amine oxide amphoteric surfactants include cocamidopropylamine oxide and lauryldimethylamine oxide (also known as dodecyldimethylamine oxide, N,N-Dimethyldodecylamine N-oxide, and DDAO), soyamidopropylamine oxide and myristamine oxide. The nitrogen atom of the amine group may be bonded to two methyl groups as shown above, however as an alternative, the nitrogen atom may be bonded to two hydroxyethyl group to provide the structure R—N$(CH_2CH_2OH)_2$—O—.

In one embodiment, the amphoteric surfactant is an amino acid amphoteric surfactant. This type of amphoteric surfactant displays a zwitterionic structure within a certain pH range, which depends on the structure of the surfactant. A common example of this type of amphoteric surfactant is the amino acids of the structure R—NH—$CH_2CH_2$—COOH where R is a fatty group. These are sometimes referred to as fatty amino acids, or more precisely as fatty aminopropionates when in the corresponding carboxylate form. A variation on this structure has two carboxylic acid groups, i.e., has the structure R—N$(CH_2CH_2COOH)_2$, which are named as fatty iminodipropionates when in the corresponding carboxylate form. Any of these classes of amphoteric surfactants may be used in the compositions of the present disclosure.

In one embodiment, the amphoteric surfactant is an amphoacetate amphoteric surfactant which includes the chemical structure —$CH_2$—$CO_2X$ in addition to a fatty group and a chemical group that will become positive charged under suitable pH. These surfactants are sometimes referred to as amphoglycinates. In one embodiment, the amphoacetate amphoteric surfactant may be represented by the chemical structure R(CO)NH—$CH_2CH_2$—N$(CH_2CH_2OH)(CH_2CO_2X)$ wherein R may be an alkyl group or R(CO) may be a fatty acyl group derived from a fatty acid such as found in coconut oil to provide, e.g., cocoamphoacetate. Such amphoacetate surfactants may be prepared by reacting a compound of formula R(CO)NH—$CH_2CH_2$—$NHCH_2CH_2OH$ with formaldehyde and a cyanide as disclosed in U.S. Pat. No. 6,232,496. Under appropriate conditions, this amphoacetate may interconvert to the corresponding amphoacetate amphoteric surfactant comprising an imidazolium group which provides a positively charged chemical group, such as lauroamphoacetate (sodium salt).

The amphoacetate amphoteric surfactant may comprise two, rather than one, acetate group, to provide an amphoteric surfactant having the chemical structure R(CO)NH—$CH_2CH_2$—N$(CH_2CH_2OCH_2CO_2X)(CH_2CO_2X)$. Exemplary amphoacetate amphoteric surfactants include disodium cocoamphodiacetate, sodium cocoamphoacetate, disodium lauroamphoacetate, and sodium lauroamphoacetate.

In one embodiment, the amphoteric surfactant is an amphopropionate amphoteric surfactant which includes the chemical structure —$CH_2CH_2$—$CO_2X$ in addition to a fatty group and a chemical group that will become positive charged under suitable pH. Such amphoteric surfactants may be prepared from acrylic acid as described in U.S. Pat. No. 6,030,938. Exemplary amphopropionate amphoteric surfactants are the sodium salts of capryloamphopropionate, lauriminodipropionate, isostearyl amphopropionate and cocoamphopropionate. The amphopropionate amphoteric surfactant may comprise two, rather than one, propionate group, to provide an amphoteric surfactant having the chemical structure R(CO)NH—$CH_2CH_2$—N$(CH_2CH_2OCH_2CH_2CO_2X)$ $(CH_2CH_2CO_2X)$. This subclass of amphopropionate amphoteric surfactants is known as amphodipropionate amphoteric surfactants, where exemplary amphodipropionate amphoteric surfactants are the disodium salt of cocoamphodipropionate (also known as N-(2-coconut oil amidoethyl)-N-(2-(2-carboxyethyl)oxyethyl)-beta-aminopropionic acid, disodium salt) and capryloamphodipropionate.

In one embodiment, the amphoteric surfactant is a betaine surfactant. Betaine refers to surfactant molecules incorporating both a positively charged (cationic) functional group such as a phosphonium or quaternary ammonium group which bears no hydrogen atom, and a negatively charged (anionic) functional group such as a carboxylate group or an oxyanion. In a betaine, the cationic and anionic groups are not adjacent to one another. The betaine surfactants as referred to herein will meet the foregoing definition, and will in addition have a lipophilic moiety. In one embodiment, the cation is a quaternary amine. In one embodiment, the anion is carboxylate. In another embodiment the anion is oxyanion. In another embodiment the anion is sulfate. In another embodiment, the anion is sulfonate. In another embodiment, the anion is phosphate. Many commercially available betaines have a dialkyl substituted dimethylammonium group. Despite the prevalence of this group in commercial amphoteric surfactants, the amphoteric surfactants useful in the present disclosure do not necessarily (although they may) have a dimethylammonium group. More generally, they have a dialkylammonium group, so as to provide, e.g., a trialkylammonium alkanoate of the chemical structure $R^1$—$N(R^2)(R^3)$—$CH_2COOX$. In other words, $R^2$ and $R^3$ are not necessarily methyl. Some exemplary betaines are alkyl dimethylbetaines of the chemical structure R—$N(CH_3)_2$—$CH_2$—COOH, and alkyl amidopropyldimethylbetaines of the structure R—CONH—$CH_2CH_2CH_2$—$N(CH_3)_2$—$CH_2$—COOH.

In one embodiment, the amphoteric surfactant is a hydroxysultaine having the chemical structure R—$N(CH_3)_2$—$CH_2CH(OH)$—$SO_3X$ where R is a fatty group, e.g., a long chain alkyl group. A hydroxysultaine is often named after the source of the R group, so that, for example, a hydroxysultaine derived from coconut oil may be named cocamidopropyl hydroxysultaine (however it is also known as coco hydroxysulfaine, and CAHS). Other exemplary hydroxysultaine amphoteric surfactants include lauramidopropyl hydroxysultaine, oleamidopropyl hydroxysultaine, tallowamidopropyl hydroxysultaine, erucamidopropyl hydroxysultaine, and lauryl hydroxysultaine.

In one embodiment, the amphoteric surfactant is an imidazoline derivative amphoteric surfactant, sometimes referred to as an imidazolinium derivative. Representing the chemical structure of an imidazoline derivative amphoteric surfactant is complicated by the fact that imidazolines characteristically hydrolyze when exposed to water. Fatty imidazolines hydrolyze slowly on exposure to moist air, giving an alkyl amidoamine. Accordingly, the alkyl amidoamine amphoteric surfactants already described elsewhere herein, are examples of imidazolinium derivative amphoteric surfactants. In general, imidazolinium derivative amphoteric surfactants, sometimes referred to as imidazoline amphoterics, are well known in the art as a class of surfactant. In one embodiment, the amphoteric surfactant is an imidazoline derivative, optionally a fatty alkyl imidazoline. This type of amphoteric surfactant form cations in acidic solutions, anions in alkaline solutions, and 'zwitterions' in mid-pH range solutions. The mid-pH range, also referred to as the isoelectric range, within which the imidazoline surfactant has a neutral charge, is compound specific and depends on the precise structure of the compound, which will affect the alkalinity of the nitrogen atom and the acidity of the carboxylic group. Exemplary suitable imidazoline type amphoteric surfactants include, without limitation, 2-cocoyl-2-imidazolinium hydroxide-1-carboxyethyloxy disodium.

The imidazolinium derivative amphoteric surfactant may be prepared by reaction of sodium chloroacetate and the corresponding 2-alkyl-1-(2-hydroxyethyol+2-imidazoline. This reaction product is commonly assigned to have the following chemical structure:

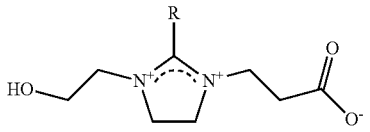

wherein R is a hydrophobic group. The reactions that produce these cyclic imidazolinium derivatives can be readily extended to provide the corresponding open chain molecules having the following structures: RCO—NH—$CH_2CH_2$—$N(CH_2CH_2OH)CH_2COO$— (with one equivalent of sodium chloroacetate) and RCO—NH—$CH_2CH_2$—$N(CH_2CH_2OH)(CH_2COO—)_2$ (with two equivalents of sodium chloroacetate). Such open chain structures are often called imidazoline derivatives, or alkyl (when R is an alkyl group) amido amino acids (when a single equivalent of sodium chloroacetate has been employed in its preparation).

Commercially available amphoteric imidazolinium may be one or more of the foregoing structures, which are suitable for use in the present disclosure. A little care should be taken in selecting the imidazolinium derivative because the same term is somewhat confusingly used to refer to cationic (as opposed to amphoteric) surfactants that incorporate or are prepared from imidazolines, e.g., the cationic surfactants having the following structure:

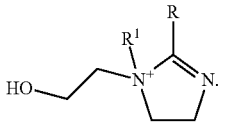

Accordingly, those skilled in the art will sometimes refer specifically to amphoteric imidazolinium surfactants to distinguish from so-called imidazolinium surfactants that are cationic.

Examples of suitable amphoteric imidazolinium derivatives having R groups selected from C6-C22 alkyl, e.g., caprylic, capric, lauric, myristic, palmitic, stearic, oleic, linoleic, linolenic, and behenic.

In one embodiment, the amphoteric surfactant is a phosphinatebetaine amphoteric surfactant. Phosphinatebetaines are similar to alkybetaines and sulfobetaines where the carboxy or sulfonic group has been replaced by a phosphine group. A phosphinatebetaine may be represented by the chemical structure R—$N(CH_3)_2$-L-P(═O)(R)OX. L may be, for example, propylene.

In one embodiment, the amphoteric surfactant is a phosphonatebetaine amphoteric surfactant. Phosphonatebetaines are similar to alkybetaines and sulfobetaines where the carboxy or sulfonic group has been replaced by a phosphonate group. A phosphonatebeaine may be represented by the chemical structure R—$N(CH_3)_2$-L-P(═O)(OR)OX. L may be, for example, propylene.

In one embodiment, the amphoteric surfactant is a pyridinium alkanoate

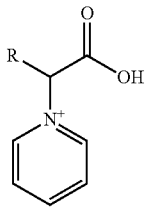

amphoteric surfactant, which may be represented by the chemical structure where R is a fatty group, e.g., a medium or long chain alkyl. The pyridinium alkanoate illustrated in the carboxylic acid form, however at suitable pH the carboxylic acid (—COOH) group will convert to the carboxylate (COOX) group.

In one embodiment, the amphoteric surfactant is a sulfate ion-containing amphoteric surfactant. The sulfate ion group may be readily added to fatty unsaturated amines, such as oleylamine (1-amino-9,10-octadecene) to provide the corresponding sulfate ion-containing amphoteric surfactant with the name 9-(10)-hydroxyoctadecylamine.

In one embodiment, the amphoteric surfactant is a sulfatobetaine, also known as an alkyldimethylammonium alkyl sulfate, which may be represented by the chemical structure $R—N(CH_3)_2$-L-$OSO_3X$. Sulfatobetaines are examples of sulfate ion-containing amphoteric surfactants that also contain the betaine group.

In one embodiment, the amphoteric surfactant is a sulfobetaine amphoteric surfactant. The chemical structure of the basic compound may be represented as $R—N(CH_3)_2$-L-$SO_2OX$ (also sometimes represented as -L-$SO_3X$). As commercially available, many sulfobetaines have L as propylene, and such amphoteric surfactants may be used in an embodiment of the present disclosure. Sulfobetaines are an example of sulfonic acid-containing amphoteric surfactants which also include a betaine group. This class of betaine amphoteric surfactant includes ammonium alkane sulfonates and 2-(N-alkyl-N,N-dimethylammonium) ethane sulfonates. Sulfobetaines also include trialkyl ammonium compounds similar to alkylbetaines but having the carboxyl group replaced by an alkylsulfonate group. When R is a lipophilic alkyl group, this class of sulfobetaine may be referred to as an alkylsulfobetaine. The alkylsulfobetaine surfactants are commonly named after the long chain alkyl group present in their structure. For example, when R has 12 carbons atoms in a straight chain, i.e., is lauryl, the corresponding sulfobetaine is known as lauryl sulfobetaine.

There are a great many sulfobetaine surfactants which are a variation on the classic structure shown above. For example, the propylene ($(CH_2)_3$) group designated by "L" may be substituted with various functional groups, e.g., halogen, hydroxyl, and methoxy. The R group need not be a straight chain alkyl group, but may be a branched or even alicyclic or aromatic hydrocarbon. Indeed, the R group need not even be a hydrocarbon. Primarily, the R group needs to be lipophilic, and a great many chemical structures provide that property. Examples of sulfobetaine surfactants suitable for use in the present invention but which do not fall within the scope of the classic structure shown above are N-(3-cocoamidopropyl)-N,N-dimethyl-N-(2-hydroxy-3-sulfopropyl)ammonium betaine, and 3-[(3-chloroamidopropyl) dimethylammonium]-1-propanesulfonate.

In one embodiment, the amphoteric surfactant is a sulfonic acid-containing amphoteric surfactant. For example, the amphoteric surfactant may be an N-alkyl taurine of the chemical formula $RNH—CH_2CH_2—SO_3H$ where R is an alkyl group. In a related embodiment, R is a fatty group. Another sulfonic acid-containing amphoteric surfactant may be prepared by sulfonation of the linear amidoamine precursor to 1-hydroxyethyl 2-alkyl imidazoline, so as to provide $R—CONH—CH_2CH_2—N(CH_2CH_2OH)CH_2CH_2SO_3H$ where R may be a fatty group, e.g., an alkyl group.

Specific examples of amphoteric surfactants and classes thereof that may be used in the present compositions include, without limitation, cocoamidopropylamine oxide, cocamidopropyl betaine, cocamidopropyl hydroxysultaine, cocodimethyl sulphopropyl betaine, disodium cocoamphodipropionate, lauryl amine oxide, lauryl amido propyl betaine; lauryl betaine, lauryl hydroxyl sulfobetaine, myristamine oxide, sodium cocoamphoacetate, and stearyl betaine. As mentioned previously, these terms do not necessarily define mutually exclusive groups of surfactants, i.e., a specific amphoteric surfactant may fall within the scope of two or more sets of amphoteric surfactants each defined one of the selected terms.

Anionic Surfactant

The fire extinguishing compositions of the present disclosure include at least one, and optionally include more than one, anionic surfactant. Suitable exemplary anionic surfactants include, without limitation, alkyl sulfates, alkylether sulfates, alkylsulfonates, alkylaryl sulfonates, alkyl succinates, alkyl sulfosuccinates, N-alkoylsarcosinates, acyl taurates, acyl isethionates, alkyl phosphates, alkyl ether phosphates, alkyl ether carboxylates, .alpha.-olefinsulfonates, and the alkali metal and alkaline earth metal salts and ammonium and triethanolamine salts thereof. Such alkyl ether sulfates, alkyl ether phosphates and alkyl ether carboxylates can have between 1 and 10 ethylene oxide or propylene oxide units, and in some embodiments, 1 to 3 ethylene oxide units, per molecule. For convenience, an anionic surfactant may be referred to by reference to the anionic group that forms the charged portion of the surfactant. For example, an anionic surfactant that comprises a sulfonate group may be referred to as a sulfonate surfactant, or even more simply when the context permits, as a sulfonate. As a further example, an anionic surfactant that comprises a sulfate group may be referred to as a sulfate surfactant, or when the context permits, even more simply as a sulfate.

In one embodiment, the anionic surfactant is a carboxylic acid or carboxylate, having the anionic group —C(O)—O— in addition to a fatty group. The fatty group, designated R herein, may be an alkyl group, in which case the carboxylate may be referred to as an alkyl carboxylate. Exemplary alkyl carboxylates are the sodium or potassium or ammonium salts of fatty acids such as stearic acid and oleic acid. Potassium oleate is an exemplary alkyl carboxylate. The fatty group may alternatively be a polyalkylene oxide group which is not water soluble. Some carboxylate anionic surfactants are prepared from an alkyl alcohol, such as octanol, which is then reacted with ethylene oxide to provide the polyoxyethyelene extended octanol known as polyoxyethylene (8) octyl ether carboxylic acid, when the average number of ethylene oxide units per molecule is 8.

In one embodiment, the anionic surfactant is a diphenyl oxide. A diphenyloxide may also be viewed as a subclass of sulfonate anionic surfactants, since the aromatic rings of the diphenyl precursor is sulfonated in order to provide the diphenyl oxide anionic surfactant. The diphenol precursor is typically a diphenylether, i.e., Ar—O—Ar, where one or both of the aromatic rings (Ar) may be substituted with an alkyl group. The diphenyl oxide anionic surfactant may be represented by the chemical formula $XSO_3$—Ar(R)—O—Ar(R)—$SO_3X$ where R is hydrogen or alkyl at each position of the aromatic ring that is not sulfonated or bonded to the ether oxygen. Exemplary diphenyl oxide anionic surfactants include disulfonated diphenyl oxide with alkyl substitution such as disulfonated diphenyl oxide with linear decyl substitution, disulfonated diphenyl oxide with linear dodecyl substitution, disulfonated diphenyl oxide with branched decyl substitution, any of which may be neutralized with sodium, potassium or ammonium.

In one embodiment, the anionic surfactant is a phosphate ester, which may be a monophosphate ester of the chemical structure R—O—$P(O)(OH)_2$, i.e., or a phosphate diester of the chemical structure R—O—P(O)(OH)—O—R where the two Rs in the diester may be the same or different. The R group is a fatty group, i.e., a non water soluble group. The R group may be an alkyl group, and phosphate esters having R=alkyl are typically made from the corresponding alkyl alcohol. In one embodiment, the R group is a polyalkylene oxide group so as to provide a polyether phosphate ester of the formula R—$(OCH_2CH_2)_n$—O—$P(O)(OH)_2$. A common naming convention for polyether phosphate esters provides the number of polyoxyethylene groups in the surfactant, e.g., polyoxyethylene (10). The R group in the polyether phosphate may be an alkyl group (when the polyether phosphate is derived from an alkyl alcohol), an aryl group (when the polyether phosphate is derived from an aromatic alcohol, e.g., phenol), or an alkyl aryl group, e.g., alkyl-substituted phenol such as nonyl-phenol. Exemplary phosphate esters include polyoxyethylene (10) nonylphenol phosphate, polyoxyethylene (4) phenol phosphate, and $C_8H_{17}$ phosphate. Commercial preparations of phosphate esters often provide a mixture of phosphate monoester and phosphate diester, which may be used in the compositions of the present disclosure.

In one embodiment, the anionic surfactant is a sarcosinate, i.e., a compound having the chemical structure R—C(O)—$N(CH_3)$—$CH_2$—$CO_2X$ where R is a fatty group. The sarcosinate surfactants include an N-acyl group, where the fatty acid from which the acyl is derived is typically used to name the sarcosinate. Exemplary sarcosinates include sodium lauroyl sarcosinate, sodium cocoyl sarcosinate, sodium myristoyl sarcosinate, and the ammonium ion equivalents.

In one embodiment, the anionic surfactant is a sulfate, i.e., a compound having the anionic —O—$SO_3X$ group in addition to a fatty group. The fatty group may be a long chain alkyl group, where an alkyl group in a surfactant may be branched or straight chain. The fatty group need not be an alkyl group, however alkyl groups are commonly available from many plant and animal oils, and so are a ready source of fatty groups for surfactants. Exemplary sulfate anionic surfactants include sodium laureth sulfate, sodium dodecyl sulfate, sodium decyl sulfate, sodium octyl sulfate, ammonium lauryl sulfate, sodium lauryl sulfate, sodium rrideceth sulfate, $C_{12-14}$-tert-alkyl-ethoxylated sodium sulfate, and poly(oxy-1,2-ethanediyl), α-sulfo-ω-(nonylphenoxy) ammonium salt.

In one embodiment, the anionic surfactant is a sulfoacetate, i.e., a compound having the anionic —$CH_2$—$SO_3X$ group in addition to a fatty group. A common fatty group has the structure R—O—C(O)—, where R is an alkyl group, e.g., $C_8$-$C_{18}$ straight chain alkyl. Exemplary sulfoacetate anionic surfactants are sodium lauryl sulfoacetate and the ammonium salt of cetyl sulfoacetate. Sulfoacetates may be prepared as described in, e.g., U.S. Pat. No. 5,616,782.

In one embodiment, the anionic surfactant is a sulfonate, i.e., a compound having the anionic —$SO_3X$ group in addition to a fatty group. The fatty group may be, for example, a long chain alkyl group. The sulfonate may be regarded as having the chemical structure R—$SO_3X$. In one embodiment, the R group is derived from a fatty acid, and is a straight long chain alky group such as stearyl and oleyl. Long chain olefins are often used as precursors to sulfonates, since the double bond may be treated to convert it to a sulfonate group. Such sulfontes are often named by the precursor which is used to form the sulfonate, such as $C_{14}$-$C_{16}$ olefin sulfonate, where $C_{14}$-$C_{16}$ denotes that a mixture of olefins having 14 and 16 carbons was sulfonates to provide the anionic surfactant. In one embodiment, the R group is an alkylbenzene group, for example, a dodecylbenzene group. The alkyl group, e.g., the dodecyl group, may be a linear alkyl group or a branched alkyl group. Exemplary sulfonate anionic surfactants are linear dodecylbenzene sulonate and branched dodecylbenzene sulfonate. As always, the anionic group may be neutralized with any suitable cation, e.g., sodium, potassium, ammonium, etc.

In one embodiment, the anionic surfactant is a sulfosuccinate, i.e., a compound having the chemical structure based on sulfonated succinic acid, i.e., Fatty Group-O—C(O)—CH2-CH(sulfate)-C(O)—O—R (which may be a fatty group or hydrogen). Sulfosuccinates are generally sodium salts of alkyl esters of sulfosuccinic acid that are a result of condensation of maleic anhydride with a fatty alcohol, followed by sulfonation with sodium bisulfite ($NaHSO_3$). As shown by the foregoing chemical structure, a sulfosuccinate will have at least one fatty group, and may have two fatty groups. However, when the sulfosuccinate has one fatty group, it may also have an anionic carboxylate group rather than a second fatty group. Exemplary sulfosuccinate anionic surfactants include sodium dioctyl sulfosuccinate (having two fatty groups) and disodium laureth sulfosuccinate (which has one fatty group, one sulfate group and one carboxylate group, and is also known as DLS).

Additional specific examples of anionic surfactants include, without limitation, ammonium lauryl sulfosuccinate, sodium lauryl sulfate, sodium lauryl ether sulfate, ammonium lauryl ether sulfate, triethanolamine dodecylbenzenesulfonate, sodium lauryl sarcosinate, ammonium lauryl sulfate, sodium oleyl succinate, sodium dodecyl sulfate, and sodium dodecylbenzene sulfonate.

In one embodiment, the fire extinguishing concentrates and compositions of the present disclosure contain a third surfactant selected from amphoteric and anionic surfactants. The third surfactant is non-identical to, i.e., is not the same as, either of the first (the amphoteric) or the second (the anionic) surfactants. Any of the amphoteric and anionic surfactants disclosed previously are optionally used as the third surfactant in the present formulations, so long as it (the third surfactant) is not the same as the first or second surfactant. In one embodiment, the third surfactant is of a different class from the first or second surfactant, i.e., the third surfactant has a different functional group from the functional groups that provide the charged functionality present in the first and second amphoteric or anionic surfactant. For example, if the second surfactant is a sulfate anionic surfactant, then the third surfactant is not a sulfate, but is instead, e.g., a sulfonate anionic surfactant.

Amphoteric and/or anionic surfactants suitable for use in the present invention may be obtained from one or more of the following exemplary manufacturers and/or suppliers: Aceto Corp. (Allendale, N.J.); Air Products (Allentown, Pa.); Akzo Nobel Chemicals Co. (Chicago, Ill.); Alzo International (Sayreville, N.J.); BASF Corp. (Florham Park, N.J.); Clariant Corp. (Frankfurt, Germany); Croda, Inc. (Edison, N.J.); Dow Chemical (Midland Mich.); E. I. du Pont de Nemours & Co., Inc. (Wilmington, Del.); Harcros Chemicals, Inc. (Kansas City, Kans.); Huntsman Corp. (St. Lake City, Utah); Kaiser Industries Ltd. (Bahadurgarh, Haryana, India), Kao Chemicals. (Tokyo, Japan); Lonza, Inc. (Basel, Switzerland); NOF Corporation (Tokyo, Japan); Pilot Chemicals (Cincinnati, Ohio); Procter & Gamble (Cincinnati, Ohio); Solvay-Rhodia (Courbevoie, France); Stepan Co. (Northfield, Ill.); and Unilever PLC (London, England).

Optional Components

The following ingredients are optionally present in the compositions of the present disclosure, however the present disclosure also provides that each of the following ingredients may be specifically excluded from being present in the composition of the present disclosure.

Block copolymer. For example, U.S. Pat. No. 7,915,212, to Yeung et al., relates to a block polymeric material having an average cationic charge density of about 15 or less, preferably 5 or less, measured as units per 100 daltons molecular weight at a pH of from about 4 to about 12. The polymeric material is disclosed as being effective in fire-fighting foam.

A nitrogen-based and phosphorus-nitrogen based fire extinguishing material selected from melamine cyanurate, melamine orthophosphate, dimelamine orthophosphate, melamine polyphosphate, melamine borate, melamine octamolybdate, tri-hydroxyethyl isocyanurate, 2,4-diamino-6-(3,3,3-trichloropropyl)-1,3,5-triazine, 2,4-di(N-hydroxymethylamino)-6-(3,3,3-trichloropropyl-1,3,5-triazine), phosphate dibasic guanidine, guanidinium dihydrogen phosphate, guanidine carbonate, guanidine sulfamate, urea, urea dihydrogen phosphate, dicyandiamide, bis(2,6,7-trioxa-1-phospha-bicyclo[2,2,2] octane-1-oxy-4-methyl) hydroxy phosphate melamine, 3,9-dihydroxy-3,9-dioxy-2,4,8,10-tetroxa-3,9-diphosphaspiro ring[5,5] undecane-3,9-dimelamine, 1,2-di(2-oxy-5,5-dimethyl-1,3-dioxa-2-phosphorus heterocyclic hexyl-2-amino) ethane, N,N'-di(2-oxy-5,5-dimethyl-1,3-dioxa-2-phosphorus heterocyclic hexyl)-2,2'-m-phenylenediamine, tri(2-oxy-5,5-dimethyl-1,3-dioxa-2-heterocyclic hexyl-2-methyl) amine or phosphonitrilic chloride trimer.

A phosphorus-halogen based fire extinguishing material selected from tri(2,2-di bromomethyl-3-bromopropyl) phosphate, tri(dibromophenyl) phosphate, 3,9-di(tribromophenoxy)-2,4,8,10-tetroxa-3,9-diphosphaspiro ring[5,5]-3,9-dioxide undecane, 3,9-di(pentabromophenoxy)-2,4,8,10-tetroxa-3,9-diphosphaspiro ring[5,5]-3,9-dioxide undecane, 1-oxo-4-tribromophenyl oxycarbonyl-2,6,7-trioxa-1-phosphabicyclo [2,2,2] octane, p-phenylene tetra(2,4,6-tribromophenyl) bisphosphate, 2,2-dimethyl-1,3-propanediyl-di (neopentyl glycolato) bisphosphate or 3,9-di(tribromo neopentyloxy)-2,4,8,10-tetroxa-3,9-diphosphaspiro ring[5,5]-3,9-dioxide undecane.

An organophosphorus-based fire extinguishing material selected from 1-oxo-4-hydroxymethyl-2,6,7-trioxa-1-phosphabicyclo [2,2,2] octane, 2,2-dimethyl-1,3-propanediyl-di (neopentyl glycolato) bisphosphate, 9,10-dihydro-9-oxa-10-phosphaphenanthrene-10 oxide, bis(4-carboxyphenyl) phenyl phosphine oxide, bis(4-hydroxyphenyl) phenyl phosphine oxide or phenyl phosphate diphenyl sulfone ester oligomer.

A chlorine-based fire extinguishing material selected from dechlorane plus, chlorendic anhydride, perchloropentacyclodecan, tetrachlorobisphenol A, chlorinated polypropylene, chlorinated polyvinyl chloride, vinyl chloride-vinylidene chloride copolymer or chlorinated polyether.

A bromine-based fire extinguishing material selected from tetrabromobisphenol A, tetrabromobisphenol A ether, 1,2-bis(tribromophenoxy) ethane, tetrabromophthalic anhydride, N,N-ethylene-bis(tetrabromophthalimide, decabromodiphenyl ether, 1,4-Bis(pentabromophenoxy)tetrabromobenzene, 1,2-bis(pentabromophenyl) ethane, bromo trimethylphenyl indane, pentabromobenzyl acrylate, hexabromo-benzene, pentabromotoluene, hexabromocyclododecane, N,N'-1,2-ethylene-bis(5,6-dibromonorbomane-2,3-dicarboximide), brominated styrene copolymer, tetrabromobisphenol A carbonate oligomer, polypentabromobenzyl acrylate or poly-dibromo phenylene ether.

The composition of the present disclosure may include a polymer dispersion in the form of a water-in-oil emulsion, such as disclosed in, e.g., EP Pat. No. 0 774 279 B1. These emulsions include a continuous oil phase in which particles of a cross-linked, water-swellable polymer are dispersed. The polymer particles have particle sizes of less than 2 μm so that they exhibit very quick swelling times of less than about 3 seconds. Along with their high water absorption capacity the water-in-oil emulsions have the properties of a thickening agent so that after their mixing with water a highly viscous fire-extinguishing agent or fire-preventing agent is obtained which adheres well to any type of surface, including a non-horizontal surface.

As mentioned previously, the compositions of the present disclosure may include a thickening agent. As used herein, upon addition to, or inclusion in, an aqueous fire extinguishing composition or concentrate thereof, the thickening agent increases the viscosity of the composition. The inclusion of a thickening agent provides for, among other things, an improved adhesion of the fire-extinguishing composition to a surface. This is particularly advantageous when the surface is not horizontal and so the firefighting composition will tend to fall down the surface under the force of gravity absent the present of a thickening agent. The thickening agent may be water soluble. Thickening agents for aqueous compositions are well known in the art, may be referred to as an aqueous thickening agent, and any of such thickening agents may be used in the present compositions.

The amount of thickening agent to be included in the composition will depend on the precise identity of the thickening agent and the desired viscosity of a concentrated form of the fire extinguishing composition. For a thickening agent selected from a cellulosic or polyamide thickening agent, and to achieve a viscosity similar to that of whole milk or orange juice, the thickening agent will typically be present in the composition at weight percent of 0.1 weight percent, based on the total weight of the composition, when the composition is a concentrate having about 5-25% total solids. The viscosity of the concentrate may be varied, primarily by the incorporation of more or less thickener. If a more viscous concentrate is desired, the addition of more thickening agent will provide for a more viscous composition. Alternatively, a more effective thickening agent may be utilized, i.e., a thickening agent that achieves the same increase in viscosity but at a lower concentration.

In one aspect, the thickening agent may be a polyhydroxy polymer, e.g., a polysaccharide such as a cellulosic or a functionalized cellulosic. When the thickening agent is a polysaccharide, the polysaccharide may have at least 50, or at least 100, or at least 150, or at least 200 saccharide units per polymer chain. The number average molecular weight of the polysaccharide may be at least 13,000 or at least 17,000 or at least 21,000 or at least 25,000.

In one aspect, the thickening agent is a polyhydroxy small molecule, such as glycerol. A polyhydroxy small molecule has a molecular weight of less than 500 g/mol and has at least three hydroxyl groups.

In one aspect, the thickening agent is a cellulosic, which includes derivatives of cellulosic resins. A suitable cellulosic is hydroxyethylcellulose (HEC). HEC is a derivative of cellulose wherein the —$CH_2OH$ groups are converted to —$CH_2OCH_2CH_2OCH_2CH_2OH$ groups, and —OH groups are converted to —$OCH_2CH_2OH$ groups. HEC is commercially available in many grades, which vary as to molecular weight and degree of derivatization, which in turn lead to different solution viscosities (typically measured at 2% solids in water). Suitable HEC is Cellosize™ from Dow Chemical (Midland, Mich.) and Aqualon™ from Ashland Chemical (Covington, Ky.).

Other suitable cellulosic thickening agents include methyl cellulose, ethyl cellulose, methylhydroxyethylcellulose, methylhydroxypropylcellulose, hydroxypropylcellulose, and anionic (salt) forms such as sodium carboxymethylcellulose, dihydroxypropyl ethers of cellulose (see, e.g., U.S. Pat. No. 4,096,326), Suitable polyhydroxy polymers other than cellulosics include corn starch or modified corn starch, potato starch or modified potato starch, and pectin or modified pectin.

The thickening agent may be a polyacrylamide. Suitable polyacrylamide thickening agents may be selected from copolymers of acrylamide and ammonium acrylate; copolymers of acrylamide or methacrylamide and methacryloyloxyethyltrimethylammonium halide, for example chloride; and copolymers of acrylamide and 2-acrylamido-2-methylpropanesulphonic acid. These copolymers may be prepared in the presence of a crosslinking agent, where exemplary crosslinking agents include divinylbenzene, tetraallyloxyethane, methylenebisacrylamide, diallyl ether, polyallylpolyglyceryl ethers or allylic ethers of alcohols of the sugar series, such as erythritol, pentaerythritol, arabitol, mannitol, sorbitol and glucose. See, e.g., U.S. Pat. Nos. 2,798,053 and 2,923,692. The polyacrylamide may be ionic and neutralized with a neutralizing agent such as sodium hydroxide, potassium hydroxide, aqueous ammonia or an amine such as triethanolamine or monoethanolamine. Ionic polyacrylamides may be prepared by copolymerizing acrylamide and sodium 2-acrylamido-2-methylpropanesulphonate via a radical route using initiators of the azobisisobutyronitrile type and by precipitation from an alcohol such as tert-butanol. A crosslinked copolymer of acrylamide and methacryloyloxyethyltrimethyl-ammonium chloride may be obtained by copolymerization of acrylamide and dimethylaminoethyl methacrylate quaternized with methyl chloride, followed by crosslinking with a compound containing olefinic unsaturation, such as methylenebisacrylamide.

The thickening agent may be a polyacrylic acid. Suitable polyacrylic acid thickening agents are commercially available. For example, Lubrizol (Wickliffe, Ohio) sells their Carbopol™ synthetic thickeners that are made from polyacrylic acid. The polyacrylic acid may be neutralized in order to adjust its thickening behavior. For example, polyacrylic acid may be neturalized with ammonium ions using, e.g., ammonium hydroxide. Ashland Chemical markets their Carbomer™ line of crosslinked polyacrylic acids. Again, these polymers need to be neutralized in order to provide effective thickening behavior.

The thickening agent may be a gum or a derivative thereof. Examples include locust bean gum and derivatives, guar gum and derivatives, and xanthan gum and derivatives. Exemplary gum derivatives include sulfonated gum, e.g., sulfonated guar, hydroxypropyl derivatized gum, e.g., hydroxypropyl guar, cationic derivatives, e.g., cationic guar, Optionally, other polymeric stabilisers and thickeners can be incorporated into the concentrate compositions of the invention to enhance the foam stability of the foam produced by aeration of the aqueous solution made from the concentrate. Examples of suitable polymeric stabilisers and thickeners are partially hydrolyzed protein, starches and modified starches, polyacrylic acid and its salts and complexes, polyethyleneimine and its salts and complexes, polyvinyl resins, e.g., polyvinyl alcohol, polyacrylamides, carboxyvinyl polymers and poly(oxyethylene)glycol.

The thickening agent may be a hydrophobically modified thickening agent. In one aspect, the thickening agent comprises a hydrophobic group such as a hydrophobic alkyl chain, where suitable examples of such thickening agents include hydrophobically modified ethylene oxide urethane (HEUR) polymer, hydrophobically modified alkali soluble emulsion (HASE) polymer, hydrophobically modified hydroxyethyl cellulose (HMHEC), and hydrophobically modified polyacrylamide (HMPA). HEUR polymers are linear reaction products of diisocyanates with polyethylene oxide end-capped with hydrophobic hydrocarbon groups. HASE polymers are homopolymers of (meth)acrylic acid, or copolymers of (meth)acrylic acid, (meth)acrylate esters, or maleic acid modified with hydrophobic vinyl monomers. HMHEC refers to hydroxyethyl cellulose modified with hydrophobic alkyl chains. HMPA refers to copolymers of acrylamide with acrylamide modified with hydrophobic alkyl chains (N-alkyl acrylamide).

As mentioned previously, the compositions of the present disclosure may include an inorganic component, optionally an inorganic salt. The inorganic component helps to cool down the burning fire: salt water has a greater heat capacity than does fresh water. As used herein, the term inorganic component refers to a chemical that does not have a carbon-hydrogen bond. The inorganic component may or may not include a metal atom or ion, although in one embodiment, the composition comprises an inorganic material having a metal, which may be referred to as an inorganic metal component. In various embodiments, the inorganic component has a molecular weight of less than 600 g/mol, or less than 400 g/mol, or less than 300 g/mol.

Suitable inorganic components which do not include a metal atom or metal ion include ammonium dihydrogen phosphate, ammonium fluoroborate, ammonium hypophosphite, ammonium orthophosphite di-hydrogen, ammonium oxalate, ammonium penta borate, ammonium phosphate, ammonium polyphosphate, ammonium sulfate, ammonium tetraborate hydrate, boron phosphate, diammonium hydrogen phosphate, guanidine nitrate, guanidine phosphate, Suitable inorganic components that include a metal atom or metal ion include alkaline aluminum oxalate, aluminum ammonium sulfate, aluminum borate whisker, aluminum dihydrogen phosphate, aluminum hydroxide, ammonium molybdate, aluminum phosphate, aluminum potassium sulfate, aluminum sulfate, ammonium heptamolybdate, ammonum octamolybdate, antimony trioxide, barium metaborate, barium sulfate, basic copper carbonate, basic zinc carbonate, beryllium carbonate, bismuth hydroxide, calcium carbonate, calcium chloride, calcium hydrogen phosphate, cerium hydroxide, cerous carbonate, chromium carbonate, cobalt hydroxide, cobaltous carbonate, dimanganese hydrogen phosphate, disodium hydrogen phosphate, di-zinc hydrogen phosphate, dolomite (calcium magnesiuim bicarbonate), dysprosium carbonate, erbium carbonate, europium carbonate, ferric hydroxide, ferrocene, ferric acetone, ferric oxide, ferroferric oxide, ferrous ammonium sulfate, ferrous carbonate, gadolinium carbonate, guanidine carbonate, holmium carbonate, hydrogen phosphate metaborate strontium, hydrogen phosphate strontium metaborate potassium, hydromagnesite, iron nitride, lanthanum carbonate, lanthanum hydroxide, lithium carbonate, lutecium carbonate, magnesium ammonium phosphate, manganese borate, magnesium dihydrogen phosphate, magnesium hydrogen phosphate, magnesium hydrogen sulfate, magnesium hydroxide, magnesium meta borate hydrate, magnesium nitrate, magnesium trisilicate, manganese carbonate, manganese citrate, manganese dihydrogen phosphate, manganese oxalate dihydrate, manganese phosphate, manganese tungstate, manganite, molybdenum hydroxide, monocalcium phosphate, monopotassium phosphate, neodymium carbonate, nickel carbonate, nickel oxalate, potassium bicarbonate, potassium hexafluorotitanate, potassium hexafluoro zirconate, potassium metaphosphate, potassium nitrate, potassium oxalate, potassium sodium carbonate hexahydrate, potassium tetra borate hydrate, potassium tripolyphosphate, praseodymium carbonate, samarium carbonate, scandium carbonate, silver carbonate, sodium bicarbonate, sodium citrate, sodium dihydrogen phosphate, sodium nitrate, sodium oxalate, sodium sesquicarbonate, sodium trimetaphosphate, sodium tungstate, strontium carbonate, strontium hydroxide, strontium metaborate, strontium tetra borate, strontium tetra borate hydrate, telluric acid, terbium carbonate, thulium carbonate, tin oxide, titanium dioxide, vanadium carbonate, ytterbium carbonate, yttrium carbonate, zinc oxide, zinc sulfide, zinc sulfate heptahydrate, zinc borate, zinc carbonate, zinc dihydrogen phosphate, zinc phosphate, zinc stannate, zirconium carbonate, and zirconium nitrate.

In one aspect, the fire extinguishing composition of the present disclosure includes an inorganic salt of an organic acid. Suitable inorganic salts of organic acids include ammonium citrate, calcium acetate, copper acetate, copper citrate, magnesium citrate, melamine phosphate salt, nickel acetate, potassium acetate, potassium citrate, sodium acetate, sodium bitartrate, strontium acetate, urea phosphate, and zinc acetate.

The amount of inorganic component present in the composition may be varied over a wide range. Based on the total weight of the solids present in the composition, the inorganic component may constitute from 1% to about 15% of that weight. In various embodiments, the inorganic component is at least 2%, or at least 3%, or at least 4%, or at least 5%, or at least 6%, or at least 7%, or at least 8%, or at least 9%, or at least 10%, or at least 11%, or at least 12%, or at least 13%, or at least 14%, or at least 15% of the total weight of the solid components of the composition. In various embodiments, the inorganic component contributes not more than 30%, or 25% or 20% or 15% or not more than 10% of the total weight of the solids present in the composition. As mentioned previously, in one embodiment the inorganic component is an inorganic salt.

In one aspect the fire extinguishing concentrates and compositions of the present disclosure include a foam-generating component or composition such as AFFF, which stands for aqueous film-forming foam, or an AR-AFFF, which stands for alcohol-resistant aqueous film-forming foam. A foam-generating component or composition (foam-generator) such as AFFF will generally contain a surfactant, and when that surfactant is one or both of an anionic surfactant and an amphoteric surfactant, the foam-generator may be used as the vehicle to introduce an anionic and/or amphoteric surfactant to the concentrates and compositions of the present disclosure. Both AFFF and AR-AFFF are available from various commercial suppliers, e.g., Kidron Industrial Materials Ltd. (Ramat-Gan, Israel) sells their Dacron AFFF, and the Chemguard company of Tyco International (Mansfield, Tex.) sells their AFFF products at a variety of solids levels. The AFFF, and consequently the concentrates and compositions of the present disclosure, may contain small amount of organic solvent(s) such as glycols, e.g., trimethyltrimethylene glycol or hexylene glycol. The AFFF, and consequently the concentrates and compositions of the present disclosure, may contain fluorinated surfactant. The foam-generator may be one described in any of U.S. Pat. Nos. 5,304,313, 5,464,544, or 5585028. The AFFF may optionally be qualified by U.S. Military Specification MIL-F-24385F.

In one embodiment, the concentrates of the present disclosure may contain small amounts of glycol ethers (glycol monoethers or glycol diethers), ethylene glycol, and/or propylene glycol. These materials may serve to extend the lifetime of a foam which may be generated from the concentrates disclosed herein. In one embodiment, the glycol is present in the concentrate at less than 10% of the total weight of the concentrate, or at less than 5% of the total weight of the concentrate, and in various embodiments is present at less than 4%, or less than 3%, or less than 2%, or less than 1%, or less than 0.9%, or less than 0.8%, or less 0.7%, or less than 0.6%, or less than 0.5%, where these percent values are weight percent based on the total weight of the concentrate. For example, the concentrate may contain ethylene glycol mono-ether, such as methyl, propyl, butyl or hexyl mono-ether, e.g., 2-butoxyethanol, in an amount of, for example, 1-8 wt % or 2-6 wt %.

The composition may comprise one or more (e.g., all of the) ingredients selected from (a) one or more water soluble polymers selected from the group consisting of xanthan gum, gellan gum, algin, locust bean gum, derivatized locust bean gum, carrageenan, quar gum, derivatized quar gum, cellulosic materials, succinoglucans, polyacrylamides, starch, and starch derivatives; (b) polyalkylene glycol; and a (c) a slurry stabilizer comprising an amine phosphate ester salt. See U.S. Pat. No. 5,969,012

The composition may comprise a fluorosurfactant, such as either an amphoteric fluorosurfactant or an anionic fluorosurfactant. The fluorosurfactant may be the fluorinated or perfluorinated analog of any of the anionic or amphoteric surfactants identified above, i.e., a fluorinated surfactant for use in the present concentrates and compositions may be any of the anionic or amphoteric surfactants identified herein wherein one or more of the C—H bonds of the anionic or amphoteric surfactant identified herein is replaced with a C—F bond. Fluorosurfactants can provide the concentrates and compositions of the present disclosure with a desirably low surface tension and positive spreading coefficient that enables the formation of an aqueous film on top of lighter liquid fuels. Such film formation is desirable in that it can contribute to rapid fire extinguishment, burn-back resistance and protection against vapor release.

As mentioned previously, the present disclosure provides a concentrate composition comprising water and solids, the solids comprising a first surfactant selected from amphoteric surfactants, a second surfactant selected from anionic surfactants, and a third surfactant selected from an amphoteric and an anionic surfactant, the third surfactant being different from the first and second surfactants. Optionally, the third surfactant, but neither of the first or second surfactants, is a fluorosurfactant. The third surfactant may be a fluorinated or perfluorinated anionic fluorosurfactant while the second (anionic) surfactant of the concentrate is non-fluorinated. Alternatively, the third surfactant may be a fluorinated or perfluorinated amphoteric surfactant while the first (amphoteric) surfactant of the concentrate is non-fluorinated. A fluorinated surfactant will contain some C—F bonds and may contain only C—F bonds (in which case it is perfluoronated) and may contain some C—H bonds (in which case it is a hydrofluorocarbon-containing molecule).

In addition to fluorinated versions of the amphoteric and anionic surfactants identified herein, other exemplary fluorosurfactants that may be included in a concentrate or composition of the present disclosure include the Captstone™ fluorosurfactants and the Forafac™ fluorosurfactants, both from DuPont (Wilmington, Del.). Other exemplary fluorosurfactants are those disclosed in any of US Patent Publication No. US 20130112908; US 20120255651; US 20110232924; US 20110091408; US 20100168318; and U.S. Pat. Nos. 8,287,752; 8,039,677; 7,977,426; and 7,989,568.

However, in another embodiment, the third surfactant is not a fluorosurfactant. Fluorine-containing compounds should be used with caution since they may have an undesirable bio-persistence profile, and/or they may break down to hazardous materials. In one embodiment, the present concentrates and compositions do not contain any fluorocarbons, while in another embodiment the present concentrates and compositions do not contain any halocarbons.

Formulations

In one embodiment, the present disclosure provides a composition comprising water and solids, the solids comprising an amphoteric first surfactant, an anionic second surfactant, and a third surfactant selected from an amphoteric and an anionic surfactant, the third surfactant being different from the first and second surfactants. In optional embodiments: the water comprises 75 to 95 wt % of the composition; e.g., the water comprises 75 to 80 wt % of the composition or the water comprises 80 to 85 wt % of the composition or the water comprises 85 to 90 wt % of the composition or the water comprises 95 to 95 wt % of the composition. In optional embodiments: the amphoteric surfactant(s) comprises 10 to 30 wt % of the solids or 15 to 25 wt % of the solids; e.g., the amphoteric surfactant(s) comprises 10 to 15 wt % of the solids or the amphoteric surfactant(s) comprises 15 to 20 wt % of the solids or the amphoteric surfactant(s) comprises 20 to 25 wt % of the solids or the amphoteric surfactant(s) comprises 25 to 30 wt % of the solids. In an optional embodiment, the amphoteric surfactant(s) comprise 1 to 5 wt % of the composition. In optional embodiments, the anionic surfactant(s) comprise 45 to 85 wt % of the solids; e.g., the anionic surfactant(s) comprise 45-55 wt % of the solids or the anionic surfactant(s) comprise 55-65 wt % of the solids or the anionic surfactant(s) comprise 65-75 wt % of the solids or the anionic surfactant(s) comprise 75-85 wt % of the solids. In an optional embodiment, the anionic surfactant(s) comprise 5 to 25 wt % of the composition.

In additional optional embodiments, the amphoteric surfactant is one or more betaines selected from cocodimethyl sulphopropyl betaine, lauryl betaine and cocamidopropyl betaine; the anionic surfactant is one or more surfactants selected from ammonium lauryl sulfosuccinatem, sodium lauryl sulfate, sodium laureth sulfate, sodium lauryl ether sulfate, ammonium lauryl ether sulfate, triethanolamine dodecylbenzenesulfonate, sodium lauryl sarcosinate, ammonium lauryl sulfate, sodium oleyl succinate, sodium dodecyl sulfate, sodium decyl sulfate, sodium octyl sulfate, and sodium dodecylbenzene sulfonate; the composition further comprises an inorganic salt, where optionally the inorganic salt comprises 2 to 20 wt % of the solids; the composition further comprises a thickening agent, where optionally the thickening agent comprises 0.1 to 5 wt % of the solids.

As mentioned previously, the compositions of the present disclosure include both of an amphoteric surfactant (and optionally more than one amphoteric surfactant) and an anionic surfactant (and optionally more than one anionic surfactant). In one aspect, the one or more amphoteric surfactant(s) contribute about an equal weight to the composition as do the one or more anionic surfactant(s). In other aspects, and again as measured on a weight basis, the amphoteric surfactant(s) contribute a lesser weight to the total weight of the composition than do the anionic surfactant(s), where in various embodiments the amphoteric surfactant(s) contribute from 1 to 50%, or from 5 to 40%, or from 10 to 30% or from 15 to 25% of the total weight of the anionic and amphoteric surfactants.

When the composition contains two of an amphoteric surfactant, or two of an anionic surfactant, the two surfactants are not necessarily present in equal weight amounts. In various embodiments, the composition comprises a first and a second anionic surfactant, where the first surfactant provides 1 to 50% of the total weight of the first and second surfactant. In additional embodiments, the first surfactant provides 1-40%, or 1-30%, or 1-20%, or 1 to 10%, or 1 to 5% of the total weight of the first and second anionic surfactants. Likewise, in various embodiments, the composition comprises a first and a second amphoteric surfactant, where the first amphoteric surfactant provides 1 to 50% of the total weight of the first and second surfactant, and in additional embodiments, the first amphoteric surfactant provides 1-40%, or 1-30%, or 1-20%, or 1 to 10%, or 1 to 5% of the total weight of the first and second amphoteric surfactants.

In one embodiment, a mixture of two amphoteric surfactants are included in a fire extinguishing composition of the present disclosure. For instance, mixtures of any of the previously mentioned amphoteric surfactants may be used. When two amphoteric surfactants are present in a composition, those two surfactants will be present in relative amounts, based on the weight of each the surfactants in the composition. For example, if the composition contains equal weights of the two amphoteric surfactants, then those two surfactants are present in a weight ratio of 1:1. If the composition contains twice as much of a first surfactant than of a second surfactant, then those two surfactants are present in a weight ratio of 1:2. If the second surfactant is present within a range of permissible weights, relative to the weight of the first surfactant, and that range is between "equal to the weight of the first surfactant" and "twice as much as the weight of the first surfactant" such that those two surfactants are present in a weight ratio of 1:(1-2).

As mentioned above, in one embodiment the present disclosure provides for the presence of two amphoteric surfactants in a composition. In various embodiments, those two amphoteric surfactants may be present at any of the following relative amounts: 1:1; 1:(1-5); 1:(1-10); 1:(1-15); 1:(1-20); 1:(1-25); 1:(1-30); 1:(5-10); 1:(5-15); 1:(5-20); 1:(5-25); 1:(5-30); 1:(10-15); 1:(10-20); 1:(10-25); 1:(10-30); 1:(15-20); 1:(15-25); 1:(15-30); 1:(20-25); and 1:(25-30).

In one embodiment, a mixture of two anionic surfactants are included in a fire extinguishing composition of the present disclosure. For instance, mixtures of any of the previously mentioned anionic surfactants may be used. When two anionic surfactants are present in a composition, those two surfactants will be present in relative amounts, based on the weight of each the surfactants in the composition. For example, if the composition contains equal weights of the two anionic surfactants, then those two surfactants are present in a weight ratio of 1:1. If the composition contains twice as much of a first surfactant than of a second surfactant, then those two surfactants are present in a weight ratio of 1:2. If the second surfactant is present within a range of permissible weights, relative to the weight of the first surfactant, and that range is between "equal to the weight of the first surfactant" and "twice as much as the weight of the first surfactant" such that those two surfactants are present in a weight ratio of 1:(1-2).

As mentioned above, in one embodiment the present disclosure provides for the presence of two anionic surfactants in a composition. In various embodiments, those two anionic surfactants may be present at any of the following relative amounts: 1:1; 1:(1-5); 1:(1-10); 1:(1-15); 1:(1-20); 1:(1-25); 1:(1-30); 1:(5-10); 1:(5-15); 1:(5-20); 1:(5-25); 1:(5-30); 1:(10-15); 1:(10-20); 1:(10-25); 1:(10-30); 1:(15-20); 1:(15-25); 1:(15-30); 1:(20-25); and 1:(25-30).

In one embodiment the present disclosure provides a fire extinguishing concentrate composition that contains 10-25 wt % of a first anionic surfactant, optionally a sulfonate surfactant such as sodium dodecylbenzene sulfonate, optionally 12-23 wt % or optionally 15-20 wt % of the first anionic surfactant; 5-15 wt % of an amphoteric surfactant, optionally a betaine surfactant such as cocamidopropyl betaine, optionally 7-13 wt % or optionally 7-11 wt % of the betaine surfactant; 1-10 wt % of a second anionic surfactant, optionally a sulfate surfactant such as sodium laureth sulfate or sodium dodecyl sulfate, optionally 2-8 wt % or 3-7 wt % of the second anionic surfactant; up to about 5 wt % of an organic solvent, optionally a glycol ether such as ethylene glycol butyl ether, optionally 1-4 wt % or 2-3 wt % of glycol ether; 2-15 wt % of a thickener such as a cellulosic thickener, e.g., hydroxyethyl cellulose, optionally 4-12 wt % or 6-10 wt % of the thickener; up to about 10 wt % of calcium chloride, optionally 2-7 wt % or 3-6 wt % of calcium chloride. Optionally the concentrate may contain a third anionic surfactant, such as sodium octyl sulfate, in an amount of up to about 5 wt %. Water will also be present in the concentrate. The total non-aqueous content of the concentrate is about 25-75 wt %, or about 30-70 wt %, or about 35-55 wt %, or about 40-50 wt % (in the last case the water content is 50-40 wt %).

Methods of Manufacture

In one aspect, the present disclosure provides methods of preparing the fire extinguishing concentrate compositions and the corresponding fire extinguishing compositions as identified herein. In general, the concentrates are prepared by combining water with at least three different surfactants selected from anionic and amphoteric surfactants, along with optional ingredients. The compositions are prepared by diluting the concentrate with water or aqueous solution.

In one embodiment, a concentrate is prepared by combining a first surfactant which is an amphoteric surfactant, a second surfactant which is an anionic surfactant, and a third surfactant selected from an amphoteric and an anionic surfactants, where the third surfactant is other than the first or second surfactants. The concentrate may optionally contain additional surfactant(s), i.e., a fourth, fifth, etc. surfactant. In addition, or alternatively, the concentrate may contain active ingredient(s) other than surfactant, e.g., inorganic components, organic solvents and thickening agents. The compositions are water based, in other words, they are aqueous compositions in that the carrier is primarily water. The compositions may be prepared by any of the following methods.

In one embodiment, a container of water is provided. This container holds between about 5 and 20 Kg of water. Of course, this method may be scaled up or down so as to provide the desired amount of fire extinguishing concentrate. The initial amount of water is about 5-40%, or about 10-30% of the total amount of water in the concentrate. The water may be at ambient temperature or it may be at an elevated temperature. Elevated temperatures of below the boiling point of water, i.e., below 100° C., or below 90° C., or below 80° C., or below 70° C. may be used. Elevated temperatures in excess of the ambient temperature, e.g., above 25° C., or above 30° C., or above 40° C., or above 50° C., or above 60° C., or above 70° C. may be used.

The surfactants are then added to the water. In one embodiment an amphoteric surfactant is added to the water, followed by the sequential addition of a first and second anionic surfactant. In an alternative embodiment, an anionic surfactant is added first to the water, followed by an amphoteric surfactant, which in turn is followed by the addition of either a second anionic surfactant or a second amphoteric surfactant. In another embodiment, the first and second anionic surfactants are added sequentially, followed by the addition of an amphoteric surfactant.

After the addition of a surfactant to the water, the resulting mixture is stirred to provide a homogeneous or near homogeneous state. Stirring may be performed leisurely or vigorously, however in either event it is preferred that undue amounts of foam are not created. Foam typically results from the entrapment of air in the mixture, where air tends to become entrapped when there is a significant vortex created during the mixing process and/or when the stirring device repeated enters and exits the mixture. Foam retention also tends to be greater when the viscosity of the mixture is greater. These situations are preferably avoided in order to minimize foam production. In order to assure good mixing, a stirring time of about 15-60 minutes may be employed after the addition of each surfactant.

Depending on the presence or absence of insulation surrounding the container in which the concentrate is being prepared, the temperature of the mixture may drop during the surfactant addition and stirring steps. Alternatively, the temperature of the mixture may be maintained at or nearly at the original temperature of the water by, for example, maintaining gentle heating directed to the sides and/or the bottom of the container which holds the concentrate. Alternatively, or additionally, heating coils may be positioned within the container to add or withdraw heat from the concentrate as desired.

As surfactant is added to the water, the viscosity of the mixture will tend to increase. A solution of increased viscosity will tend to entrap air more readily than does a lower viscosity solution, all other factors being equal. In order to reduce the viscosity of a mixture, additional water may be added to the mixture after the addition of any of the first, second or third surfactants. For example, an amount of water which is about 5-40%, or about 10-30% of the total amount of water in the concentrate may be added to the mixture after the first addition of surfactant. In addition, or alternatively, an amount of water which is about 5-40%, or about 10-30% of the total amount of water in the concentrate may be added to the mixture after the second addition of surfactant.

After all of the surfactants have been added and thoroughly mixed into the water, optional ingredient(s) may be added to the resulting mixture. For example, an inorganic component, e.g., an inorganic salt, may be added to the mixture, followed by stirring to completely dissolve the inorganic component. The optional ingredient(s) may be added to the warm or hot mixture, or to the mixture after it has cooled down to room temperature. Since the concentrate will typically be stored and used at room temperature, any optional ingredients that will significantly impact the viscosity or flow properties of the mixture are typically added to the mixture at room temperature.

The surfactants and optional ingredients may be added to the water in a neat form, i.e., without being in contact with a solvent, or may be added in a diluted form, i.e., in contact with a solvent so as to provide a solution, paste, dispersion, etc. of the ingredient. In one embodiment, the surfactants are added to water in the order of their solids content in water, with the more concentrated ingredient being added first. In other words, if a surfactant is at 50% solids and another surfactant is at 25% solids, then the surfactant at 50% solids is added to water before the surfactant at 25% solids is added to the mixture.

The concentrate may be prepared in a batch, continuous or semi-continuous mode. In a batch mode, ingredients are added sequentially to a container of water, until all of the ingredients have been added, in which case a batch of concentrate has been prepared. In a continuous mode, water is propelled through a pipe or other conduit, and various ingredients are added to the water at various points along the conduit. For example, the conduit may be fitted with T-valves, where an ingredient may be fed into the water, or aqueous mixture, through the T-valve. The conduit may also contain mixers within the conduit, either static or inline mixers, to facilitate the creation of a homogenous mixture after an ingredient has been added to the water or aqueous mixture. For example, water and a first surfactant may be fed into a pipe and pass through a mixer. Typically a static mixer is adequate if the surfactant is pre-dissolved in water. Otherwise, an inline mixer is typically preferred. Thereafter, a second surfactant is added to the conduit downstream of the mixer, which again goes through a mixing process. Finally, a third surfactant is added to the aqueous mixture, following by mixing as needed, so as to provide an aqueous mixture comprising three surfactants. Thereafter, additional, optional ingredients may be added to the conduit, through a T-valve for example, following by suitable stirring, to form the final concentrate.

To facilitate mixing of the various ingredients, and to minimize vortex formation and consequently foam formation, baffles may be installed within the batch or continuous reactor. Suitable mixing equipment, such as agitators, impellers, static mixers, colloid mills, and homogenizers are made and sold by, e.g., Chemineer (Dayton, Ohio) and Sulzer (Winterthur, Switzerland).

In an alternative embodiment for a continuous process, three T-valves are located at the beginning of the conduit, at a location after water has already been added to the conduit. The first, second and third surfactants are each delivered into the conduit through one of the three T-valves. In this manner, all of the three surfactants are combined essentially at the same time, and then the resulting mixture is passed through an inline or static mixer within the conduit, to provide a homogenous aqueous mixture. Optional ingredients are then added to the homogeneous aqueous mixture as desired, to provide the final concentrate.

In either a continuous or batch process, the water and/or aqueous mixture may be heated to a temperature in excess of ambient temperature, e.g., a temperature between 50° C. and 90° C. Heating may be accomplished by routine methods known in the art. The elevated temperature may be maintained as needed to facilitate prompt mixing of the ingredients to form a homogeneous mixture.

Accordingly, in one embodiment, the present disclosure provides a continuous process for making a fire extinguishing concentrated composition. The process comprises providing a continuous reactor, charging water to the continuous reactor, adding to the water in the continuous reactor a) a first anionic surfactant, b) a second amphoteric surfactant, and c) a third surfactant selected from an anionic surfactant and a cationic surfactant, the third surfactant being different from the first surfactant and the second surfactant; and mixing components a), b) and c) to provide a homogeneous mixture. Optionally, the continuous reactor is maintained at a temperature in excess of 50° C. Also optionally, a mixer selected from an in-line mixer and a static mixer is present in the continuous reactor.

Method of Use

The present disclosure provides fire extinguishing concentrates that may be used in the course of extinguishing a fire. In one embodiment, the fire extinguishing concentrate is diluted with water to provide a fire extinguishing composition that is applied directly to the fire. The concentrate will have a solids level or content, measured as the sum of the weights of the non-aqueous components in the concentrate, divided by the total weight of the concentrate. When water is combined with concentrate so as to form a fire extinguishing composition, the fire extinguishing composition will likewise have a solids level or content, which will be less than the solids level or content of the concentrate. In various embodiment, the composition is formed by combining sufficient water with the concentrate so as to provide a fire extinguishing composition having a weight percent solids, based on the total weight of composition, of 0.1%, or 0.5%, or 1%, or 1.5%, or 2%, or 2.5%, or 3%, or 3.5%, or 4%, or 4.5%, or 5%, or 5.5%, or 6%, or 6, 5%, or 7%, or 7.5%, or 8%, or 8.5%, or 9%, or 9.5%, or 10%, or 10.5%, or 11%, or 11.5%, or 12%, or 12.5%, or 13%, or 13.5%, or 14%, or 14.5%, or 15%, or 15.5%, or 16%, or 16.5%, or 17%, or 17.5%, or 18%, or 18.5%, or 19%, or 20%, or a concentration within a range provided any of the two aforesaid solids percent values, e.g., 0.5% to 4%.

In one aspect, the prepared person will have a supply of fire extinguishing concentrate in storage, readily available when needed to extinguish a fire, and with access to a method of combining the concentrate with water so as to form a fire fighting composition. In one embodiment, the dilution process takes advantage of the Venturi effect, observed when a fluid such as water flows through a tube that narrows to provide a partial restriction having a narrower smaller diameter than the bulk tube. In this situation, the partial restriction causes an increase in pressure within the tube, and this pressure difference causes the fluid to accelerate toward the low pressure narrow section, in which it thus maintains a higher speed. When pure water flows through the tube, and the tube is in fluid communication with a reservoir of fire extinguishing concentrate of the present disclosure, this change in pressure (the Venture effect) can be used to draw the concentrate from the reservoir and into the pure water, thereby diluting the concentrate and forming a fire extinguishing composition.

This Venturi effect may be used to prepare a fire fighting composition of the present disclosure. For example, an airplane flying over a fire may hold a container of water and a container of concentrate. Nozzles are directed to the fire, where the nozzles are connected to tubing that is in fluid communication with both the pure water and the concentrate of the present disclosure. When water is pumped out of the reservoir and through the nozzle, a Venturi effect may be established which will draw concentrate from the reservoir and into the water. The water and concentrate will mix in the nozzle to provide the fire extinguishing composition of the present disclosure, which is then directed onto the fire from the airplane.

In a related aspect, and a on a much small scale, a container of fire extinguishing concentrate may be placed under the sink of a family home. The container is affixed to tubing which, when a fire presents itself, may be connected to the faucet of the sink. Upon turning on the faucet, a Venturi effect may be created, which will draw concentrate into the tubing. The tubing will have a nozzle which can be directed at the fire. In this way, fire extinguishing composition may be formed in a family home and used to extinguish dangerous fires.

The fire extinguishing concentrates as disclosed herein may be diluted with water to create a fire extinguishing composition. The dilution process may optionally involve any of a fixed or portable in-line educator, an in-line balanced pressure and pump pressure proportioning ski, a bladder tank balanced pressure proportioning system, an around the pump proportioner, or a handline air-aspirating nozzle with fixed educator pickup tube. The fire extinguishing composition may optionally be discharged onto a fire by using any of a foam chamber, an air-aspirating or non-air-aspirating sprinkler head or spray nozzle, a standard water fog nozzle for handlines and monitors, an air-aspirating foam nozzle, a foam maker for use with either Floating Roof storage tanks for Dike/Bund protection systems, or a high back pressure foam making for subsurface base injection systems.

Methods that may be used to store and/or deliver fire extinguishing concentrates and compositions of the present disclosure may be found in, for example, US patents and Patent Publication Nos. U.S. Pat. Nos. 8,646,540; 8,505,642; 8,459,369; 8,453,751; 8,439,123; 8,087,468; 8,042,619; 7,905,296; 7,823,650; 5,762,145; US20130211173; US20130025888; and US20120199370.

The fire extinguishing concentrates and compositions of the present disclosure may be used to extinguish various categories of fire. For example, the concentrates and composition of the present disclosure may be used for combating hydrocarbon fires, such as fires in which the hydrocarbons are petrols, oils, diesel oil, fuel oil, heptane, hexane or cyclohexane. As another example, the firefighting concentrates and compositions of the present disclosure may be used for combatting polar liquid fires, such as fires in which the polar liquids are alcohols (for example, methanol, ethanol and isopropanol), ketones (for example, dimethyl ketone and methyl isobutyl ketone), esters (for example, n-butyl acetate) and ethers (for example, methyl tert-butyl ether). As another example, the concentrates and compositions of the present disclosure may be used for combating Class A fires which are fires fueled by burning materials which leave an ash residue such as paper, wood, cloth, rubber, and certain plastics.

The following examples are provided to illustrate embodiments of the present disclosure and are not to be construed as limiting thereon.

EXAMPLES

In the following examples, the indicated commercial products may not have the solids content or the neutralization indicated as being used in the example. In such a case, the commercial product may be diluted with water to the indicted solids content and/or neutralized with acid or base as needed to provide the indicated neutralized form. The thickening agent is added to provide a final viscosity approximately that of whole milk or orange juice.

Example 1

To about 10 kg of heated water (about 75° C.) is sequentially added the following ingredients, each ingredient addition being followed by stirring for a period of about 30 minutes in a manner that minimizes foam formation: first anionic surfactant solution (about 9 kg at about 60% solids in water of branched chain sodium dodecylbenzene sulfonate, e.g., SULFONIC 100 from Stepan Company, after neutralization with sodium hydroxide), amphoteric surfactant solution (about 4.5 kg at about 35% solids in water of cocamidopropylbetaine, e.g., AMPHOSOL CA from Stepan Company), heated water (about 9 kg), second anionic surfactant solution (about 11 kg at about 3% solids in water of sodium lauryl ether sulfate, e.g., CALFOAM ES-703 from Pilot Chemical Co.), and inorganic salt solution (about 2 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., AQUALON, Ashland Chemicals, Covington, Ky.) is added to provide the final fire extinguishing concentrate.

Example 2

To about 10 kg of heated water (about 75° C.) is sequentially added the following ingredients, each ingredient addition being followed by stirring for a period of about 30 minutes in a manner that minimizes foam formation: first anionic surfactant solution (about 9 kg at about 53% solids in water of triethanolamine dodecylbenzene sulfonate, CALSOFT T60 (Pilot Chemical), amphoteric surfactant solution (about 4.5 kg at about 35% solids in water of sodium cocoamphoacetate, AMPHITOL 20Y-B (Kao Chemicals), heated water (about 6.5 kg), second anionic surfactant solution (about 14 kg at about 7% solids in water of ammonium lauryl sulfate, EMAL AD-25R (Kao Chemicals)), and inorganic salt solution (about 2 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., WALOCEL CRT, Dow Chemical) is added to provide the final fire extinguishing concentrate.

Example 3

To about 8 kg of heated water (about 75° C.) is sequentially added the following ingredients, each ingredient addition being followed by stirring for a period of about 30 minutes in a manner that minimizes foam formation: first anionic surfactant solution (about 8.5 kg at about 53% solids in water of sodium lauryl sulfoacetate, LATHANOL LAL flake (Stepan Co.), amphoteric surfactant solution (about 6.3 kg at about 30% solids in water of lauryl hydroxysultaine, AMPHITOL 20HD, Kao Chemicals), heated water (about 6.5 kg), second anionic surfactant solution (about 14 kg at about 7% solids in water of sodium octyl phenol ethoxylate sulfate, POE-3, POLY-STEP C-OP3S (Stepan Co.)), and inorganic salt solution (about 2 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., AQUALON, Ashland Chemicals, Covington, Ky.) is added to provide the final fire extinguishing concentrate.

Example 4

To about 8.5 kg of heated water (about 75° C.) is sequentially added the following ingredients, each ingredient addition being followed by stirring for a period of about 30 minutes in a manner that minimizes foam formation: first anionic surfactant solution (about 9 kg at about 53% solids in water of polyoxyethylene (10) nonylphenol phosphate, FOSFODET 9Q/22 (Kao Chemicals)), amphoteric surfactant solution (about 5.3 kg at about 35% solids in water of disodium cocoamphodipropionate, CRODATERIC CADP 38 (Croda)), heated water (about 6 kg), second anionic surfactant solution (about 14 kg at about 7% solids in water of sodium dioctyl sulfosuccinate, STEPWET DOS-70 (Stepan Co.)), and inorganic salt solution (about 3.3 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., WALOCEL CRT, Dow Chemical) is added to provide the final fire extinguishing concentrate.

Example 5

To about 15 kg of heated water (about 75° C.) is sequentially added the following ingredients, each ingredient addition being followed by stirring for a period of about 30 minutes in a manner that minimizes foam formation: first anionic surfactant solution (about 5 kg at about 53% solids in water of polyoxyethylene (8) octyl ether carboxylic acid, AKYPO LF2 (Kao Chemical)), amphoteric surfactant solution (about 8.3 kg at about 30% solids in water of cocamidopropylamine oxide, CALOXAMINE CPO (Pilot Chemical)), heated water (about 14 kg), second anionic surfactant solution (about 7.5 kg at about 20% solids in water of sodium lauroyl sarcosinate, MAPROSYL 30-B (Stepan Co.)), and inorganic salt solution (about 3.3 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., AQUALON, Ashland Chemicals, Covington, Ky.) is added to provide the final fire extinguishing concentrate.

Example 6

To about 14 kg of heated water (about 75° C.) is sequentially added the following ingredients, each ingredient addition being followed by stirring for a period of about 30 minutes in a manner that minimizes foam formation: first anionic surfactant solution (about 5.6 kg at about 50% solids in water of potassium oleate, ICTEOL K-50 (Kao Chemicals)), amphoteric surfactant solution (about 8.3 kg at about 30% solids in water of cocamidopropyl betaine, CALTAINE C-35 (Pilot Chemical), heated water (about 15 kg), second anionic surfactant solution (about 6 kg at about 20% solids in water of disulfonated diphenyl oxide with linear decyl substitution, DOWFAX C10L, (Dow Chemical)), and inorganic salt solution (about 3.3 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., WALOCEL CRT, Dow Chemical) is added to provide the final fire extinguishing concentrate.

Example 7

To about 15 kg of heated water (about 75° C.) is sequentially added the following ingredients, each ingredient addition being followed by stirring for a period of about 30 minutes in a manner that minimizes foam formation: first anionic surfactant solution (about 5 kg at about 50% solids in water of isopropylamine dodecylbenzene sulfonate, NINATE 411 (Stepan Co.)), amphoteric surfactant solution (about 10 kg at about 30% solids in water of cocamidopropyl hydroxysultaine, AMPHOSOL CS-50 (Stepan), heated water (about 15 kg), second anionic surfactant solution (about 5 kg at about 30% solids in water of sodium dodecylbenzene sulfonate, MELIOSOL 50X (Kao Chemical), and inorganic salt solution (about 3.3 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., AQUALON, Ashland Chemicals, Covington, Ky.) is added to provide the final fire extinguishing concentrate.

Example 8

To about 20 kg of heated water (about 75° C.) is sequentially added the following ingredients, each ingredient addition being followed by stirring for a period of about 30 minutes in a manner that minimizes foam formation: first anionic surfactant solution (about 8.4 kg at about 50% solids in water of disulfonated diphenyloxide with alkyl substitution, DOWFAX C10L (Dow Chemical)), amphoteric surfactant solution (about 6.7 kg at about 30% solids in water of lauramidopropylbetaine, AMPHITOL 20AB (Kao Chemicals), heated water (about 12 kg), second anionic surfactant solution (about 4 kg at about 20% solids in water of sodium C14-C16 olefin sulfonate, ALFANOX 46 (Kao Chemical), and inorganic salt solution (about 1.7 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., WALOCEL CRT, Dow Chemical) is added to provide the final fire extinguishing concentrate.

Example 9

To about 10 kg of heated water (about 75° C.) is sequentially added the following ingredients, each ingredient addition being followed by stirring for a period of about 30 minutes in a manner that minimizes foam formation: first anionic surfactant solution (about 9 kg at about 60% solids in water of linear chain sodium dodecylbenzene sulfonate, e.g., CALSOFT F90 (Pilot Chemical)), amphoteric surfactant solution (about 4.5 kg at about 35% solids in water of cocamidopropylbetaine, e.g., AMPHOSOL CA from Stepan Company), heated water (about 9 kg), second anionic surfactant solution (about 11 kg at about 3% solids in water of sodium lauryl ether sulfate, e.g., CALFOAM ES-703 from Pilot Chemical Co.), and inorganic salt solution (about 2 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., AQUALON, Ashland Chemicals, Covington, Ky.) is added to provide the final fire extinguishing concentrate.

Example 10

To about 10 kg of heated water (about 75° C.) is sequentially added the following ingredients, each ingredient addition being followed by stirring for a period of about 30 minutes in a manner that minimizes foam formation: first anionic surfactant solution (about 9 kg at about 60% solids in water of linear chain sodium dodecylbenzene sulfonate, e.g., CALSOFT F90 (Pilot Chemical)), amphoteric surfactant solution (about 4.5 kg at about 35% solids in water of cocamidopropyl betaine, e.g., AMPHOSOL CA from Stepan Company), heated water with dissolved ethylene glycol butyl ether (about 9 kg water and about 1 kg ether), second anionic surfactant solution (about 11 kg at about 3% solids in water of sodium laureth sulfate, e.g., CALFOAM ES-703 from Pilot Chemical Co.), and inorganic salt solution (about 2 kg at about 30% solids in water of calcium chloride, where calcium chloride in both solid and solution forms is available from e.g., OxyChem, Ludington, Mich.). The resulting mixture is allowed to cool to ambient temperature (about 8 hours) and then thickening agent (about 4 kg of about 1.5% solids in water of sodium carboxy methyl cellulose, e.g., AQUALON, Ashland Chemicals, Covington, Ky.) is added to provide the final fire extinguishing concentrate.

The efficacy of the fire extinguishing concentrates and compositions of the present disclosure may be evaluated by one or more test methods that indicate the effectiveness of the composition at extinguishing a fire. The following are exemplary test methods that may be employed.

A test fire is prepared using 19.5"×19.5" pan filled with 1" water and 1" diesel with a splash of heptane. A nozzle is positioned directly over the pan at a height of 37.5" above the base of the pan. A discharge cylinder is filled with 1 L of fire extinguishing composition at 3.5% solids and pressurized to 250 PSI using Nitrogen. The fire is ignited and after a 2 min pre-burn the composition is discharged. The time to completely put out the fire is measured.

A test fire of size 28 ft2 is produced in a level, circular pan 6 feet in diameter, fabricated from 0.25-in. thick steel with a 4-in. high side. A shallow water layer is used to protect the pan bottom and to ensure complete coverage of the area with fuel. A nozzle is used to deliver the composition onto the fire, e.g., a nozzle used for foam application is a 2 gal/min nozzle. Ten gallons of unleaded gasoline fuel that conform to ASTM D439 is dumped within a 30-sec period, ignited within 30 sec of fueling, and allowed to burn freely for 10 sec. After the preburn period, the fire is attacked and extinguished as quickly as possible. The time to completely put out the fire is measured.

A test fire is prepared by securing tires to a test structure and then applying 50/50 mixture of kerosene and diesel fuel directly to the tires prior to ignition. Fire accelerant is optionally applied to the tires after the test is initiated to increase the combustion of the tires. After allowing the tires to burn for sufficient time to insure that the rubber is on fire and that the flames are not simply emanating from the combustion of the accelerant, a composition of the present disclosure is directed onto the burning tires. The time to extinguish all visible flames is measured. For example, one tire and approximately 1 kg of poly foam are lit on fire. The poly foam essentially serves as a kindling: it easily ignites and continuously burns adjacent to the tire, thereby heating and eventually igniting the tire. After the tire has begun burning, two hundred milliliters of diesel is added to accelerate the fire. Once the fire reaches approximately 750-850 degrees C., attempts are made to extinguish the fire with different fire retardants. In one instance, successive canisters of a 3 kg ABC dry chemical fire extinguisher are applied to the fire. Although each application of the dry chemical fire extinguishers may slow or appear to temporarily extinguish the fire, they are ineffective at permanently putting out the fire, which can regain its full flame even after depletion of three canisters. In contrast, a 400 cc aerosol bottle of fire extinguisher composition according to the present disclosure (such as disclosed in Examples 1-10) is applied to a separately burning tire (prepared as described above). Application of about ⅔ of the 400 cc bottle may readily extinguish the fire. The fire may return after a minute or so, however application of the remaining ⅓ of the 400 cc bottle of fire extinguisher composition may permanently extinguish the fire. The approximate temperature of the fire after extinguishment by such compositions is 55 to 65 degrees C. The fire extinguisher composition of the present disclosure therefore demonstrate a much more effective ability to extinguish the fire of a burning tire compared to standard ABC type fire extinguisher compositions A test fire is prepared using a steel plate of dimension ¼"×24"×36" with a drain hole on one end of the plate. A ¼"×2" 90 degree-edge is welded around the perimeter of the plate to contain excess splatter. A five (5) gram mound of magnesium is placed on the steel plate about 6" from each side of one corner. The magnesium is ignited and allowed to burn for about seven (7) seconds. At that time composition of the present disclosure is applied to the fire, using a one-quart spray mist bottle filled with the composition. The extinguishment time and the flare-up size of the magnesium fire are noted.

A test fire is prepared by placing 1 liter of salad oil into a pan of radius 30 cm, and heating the oil to about 400° C., whereupon it ignites. A 500 mL portion of the fire extinguishing composition of the present disclosure is sprayed over the flame. The time to extinguish the flame is measured.

The present disclosure includes the following numbered embodiments, which are exemplary only and not a limitation on the various embodiments of the present disclosure:

1. A composition comprising water and dissolved or suspended solids, the solids comprising a first surfactant selected from amphoteric surfactants and a second surfactant selected from anionic surfactants.
2. The composition of embodiment 1, wherein the first surfactant is a betaine surfactant, or in other words, is a surfactant that comprises a betaine group.
3. The composition of embodiment 1, wherein the first surfactant is an amido propyl betaine.
4. The composition of embodiment 3 wherein the amido propyl betaine is cocamido propyl betaine.
5. The composition of embodiment 3 wherein the amido propyl betaine is isostearyl propyl betaine.
6. The composition of embodiment 3 wherein the amido propyl betaine is lauramido propyl betaine.
7. The composition of embodiment 1 wherein the first surfactant is an amphoacetate surfactant.
8. The composition of embodiment 7 wherein the amphoacetate is the sodium salt of cocoamphoacetate.
9. The composition of embodiment 7 wherein the amphoacetate is the sodium salt of lauroamphoacetate.
10. The composition of embodiment 1 wherein the first surfactant is an amphopropionates surfactant.
11. The composition of embodiment 10 wherein the amphopropionate is the disodium salt of cocoamphodipropionate.
12. The composition of embodiment 10 wherein the amphopropionate is the sodium salt of capryloamphopropionate.
13. The composition of embodiment 1 wherein the first surfactant is a hydroxysultaine surfactant.
14. The composition of embodiment 13 wherein the hydroxysultaine is cocamidopropyl hydroxyl sultaine.
15. The composition of embodiment 13 wherein the hydroxysultaine is oleamidopropyl hydroxyl sultaine.
16. The composition of embodiment 13 wherein the hydroxysultaine is lauryl hydroxyl sultaine.
17. The composition of embodiment 1 wherein the first surfactant is an amine oxide surfactant.
18. The composition of embodiment 17 wherein the amine oxide is cocamidopropylamine oxide.
19. The composition of embodiment 17 wherein the amine oxide is N,N-(dihydroxyethyl) myristamine oxide.
20. The composition of embodiment 1 wherein the first surfactant is an imidazoline derivative.
21. The composition of embodiment 20 wherein the imidazoline derivative is an am phoglycinate.
22. The composition of each of embodiments 1-21 wherein the second surfactant is a sulfonate surfactant, or in other words, the second surfactant comprises a sulfonate group.
23. The composition of embodiment 22 wherein the sulfonate is the sodium salt of a linear dodecylbenzene sulfonate.
24. The composition of embodiment 22 wherein the sulfonate is the sodium salt of a $C_{14}$-$C_{16}$ olefin sulfonate.
25. The composition of embodiment 22 wherein the sulfonate is the sodium salt of a branched dodecylbenzene sulfonate.
26. The composition of embodiment 22 wherein the sulfonate salt is the triethanolamine salt of a linear or branched dodecylbenzene sulfonate.
27. The composition of embodiment 22 wherein the sulfonate salt is the isopropylamine salt of linear or branched dodecylbenzene sulfonate.
28. The composition of each of embodiments 1-21 wherein the second surfactant is a sulfate, or in other words, the second surfactant comprise a sulfate group.
29. The composition of embodiment 28 wherein the sulfate is a sodium salt of lauryl ether sulfate.
30. The composition of embodiment 28 wherein the sulfate is an ammonium salt of lauryl sulfate.
31. The composition of embodiment 28 wherein the sulfate is sodium octyl sulfate.
32. The composition of embodiment 28 wherein the sulfate is sodium dodecyl sulfate.
33. The composition of embodiment 28 wherein the sulfate is a sodium salt of an ethoxylated $C_6$-$C_{12}$ alcohol.
34. The composition of claim 28 wherein the sulfate is sodium laureth sulfate.
35. The composition of embodiment 28 wherein the sulfate is $C_{12}$-$C_{14}$ tert-alkyl-ethoxylated sodium sulfate.
36. The composition of each of embodiments 1-21 wherein the second surfactant is a sulfoacetate surfactant.
37. The composition of embodiment 36 wherein the sulfoacetate is the sodium salt of lauryl sulfoacetate.
38. The composition of embodiment 36 wherein the sulfoacetate is the ammonium salt of cetyl sulfoacetate.
39. The composition of each of embodiments 1-21 wherein the second surfactant is a phosphate surfactant selected from monoester and diester phosphate surfactants.
40. The composition of embodiment 39 wherein the phosphate is polyoxyethylene (10) nonylphenol phosphate.
41. The composition of embodiment 39 wherein the phosphate is the sodium salt of $C_8H_{17}$ phosphate.
42. The composition of each of embodiments 1-21 wherein the second surfactant is a sulfosuccinate surfactant.
43. The composition of embodiment 42 wherein the sulfosuccinate is sodium dioctyl sulfosuccinate.
44. The composition of embodiment 42 wherein the sulfosuccinate is disodium laureth sulfosuccinate.
45. The composition of each of embodiments 1-21 wherein the second surfactant is a carboxylate.
46. The composition of embodiment 45 wherein the carboxylate is a sodium salt of polyoxyethylene (8) octyl ether carboxylic acid.
47. The composition of embodiment 45 wherein the carboxylate is sodium salt of stearic acid.
48. The composition of each of embodiments 1-21 wherein the second surfactant is a sarcosinate.
49. The composition of embodiment 48 wherein the sarcosinate is sodium lauroyl sarcosinate.
50. The composition of embodiment 48 wherein the sarcosinate is ammonium cocoyl sarcosinate.
51. The composition of each of embodiments 1-21 wherein the second surfactant is a diphenyl oxide surfactant.
52. The composition of embodiment 51 wherein the diphenyl oxide is disulfonated diphenyl oxide with linear decyl substitution, sodium salt.
53. The composition of embodiment 51 wherein the diphenyl oxide is disulfonated diphenyl oxide with branched dodecyl substitution.

54. The composition of embodiment 1 wherein the first surfactant comprises a betaine and the second surfactant comprises a sulfonate.
55. The composition of embodiment 54 wherein the first surfactant is an amido propyl betaine surfactant, optionally cocamidopropyl betaine, and the second surfactant is an alkylaryl sulfonate surfactant, optionally a salt of dodecylbenzene sulfonate.
56. The composition of embodiment 1 wherein the first surfactant comprises an amphoacetate and the second surfactant comprises a sulfonate.
57. The composition of embodiment 1 wherein the first surfactant comprises hydroxysultaine and the second surfactant comprises sulfoacetate.
58. The composition of embodiment 1 wherein the first surfactant comprises amphodipropionate and the second surfactant comprises phosphate.
59. The composition of embodiment 1 wherein the first surfactant comprises amine oxide and the second surfactant comprises carboxylic acid, e.g., carboxylate.
60. The composition of embodiment 1 wherein the first surfactant comprises betaine and the second surfactant comprises carboxylic acid, e.g., carboxylate.
61. The composition of each of embodiments 54-60 further comprising an inorganic salt and a thickening agent as solid components.
62. The composition of each of embodiments 54-60 comprising a single amphoteric surfactant, a single anionic surfactant, inorganic salt and thickening agent.
63. The composition of any of embodiments 1-62, wherein the amphoteric surfactant comprises 10-30 wt % of the weight of the solid components.
64. The composition of any of embodiments 1-62, wherein the amphoteric surfactant comprises 15-25 wt % of the weight of the solid components.
65. The composition of any of embodiments 1-62, wherein the anionic surfactant comprises 31-60 wt % of the weight of the solid components.
66. The composition of any of embodiments 1-62, wherein the anionic surfactant comprises 40-50 wt % of the weight of the solid components.
67. The composition of any of embodiments 1-62, wherein the amphoteric surfactant comprises 15-25 wt % and the anionic surfactant comprises 40-50 wt % of the solid components.
68. The composition of any of embodiments 1-62 wherein the wt % of the anionic surfactant is 1.5 to 3 times the wt % of the amphoteric surfactant based on the total weight of surfactant present in the composition.
69. The composition of any of embodiments 1-62 wherein the wt % of the anionic surfactant is 1.5 to 2.5 times the wt % of the amphoteric surfactant based on the total weight of surfactant present in the composition.
70. The composition of any of embodiments 1-62, wherein the amphoteric surfactant comprises 15-25 wt %, the anionic surfactant comprises 40-50 wt % and the inorganic salt comprises 5-20 wt % of the solid components.
71. The composition of any of embodiments 1-62, wherein the amphoteric surfactant comprises 15-25 wt %, the anionic surfactant comprises 40-50 wt % and the inorganic salt comprises 5-20 wt % of the solid components, with the remainder of the solid components being thickening agent.
72. The composition of any of the preceding embodiments comprising an inorganic salt, where the inorganic salt is optionally calcium chloride.
73. The composition of any of the preceding embodiments comprising an aqueous thickening agent selected from a polyamide and a cellulosic thickening agent.
74. The composition of embodiment 73 wherein the aqueous thickening agent is selected from a carboxy methyl cellulose and a hydroxyethylcellulose.
75. A batch process for making a fire extinguishing concentrated composition comprising adding to a container, hot water, an anionic surfactant, an amphoteric surfactant, an inorganic salt, and a thickening agent; wherein after an addition of a component to the container, a resulting mixture is stirred to provide a homogeneous or nearly homogeneous mixture before addition of a next component.
76. The batch process of embodiment 75 for making a fire extinguishing concentrate composition comprising: (a) heating water to about 70-80° C. to provide hot water; (b) adding an anionic surfactant to the hot water; (c) adding an amphoteric surfactant to the mixture of step b); (d) adding hot water to the mixture of step c); (e) adding inorganic salt to the mixture of step (d); (f) cooling the mixture of step (e) to within ±20° C. of ambient temperature; and (g) adding thickening agent to the mixture of step f); wherein after an addition of a component, a resulting mixture is stirred for about 30 minutes to achieve a homogeneous or nearly homogeneous mixture with minimal foam generation before addition of a next component.
77. A continuous process for making a fire extinguishing concentrated composition comprising providing a continuous reactor, charging water to the continuous reactor, continuously feeding to the continuous reactor a) an anionic surfactant, b) an amphoteric surfactant, and mixing components a) and b) to provide a homogeneous mixture.
78. The continuous process of embodiment 77 further comprising continuously feeding to the reactor inorganic salt and thickening agent.
79. The continuous process of embodiment 78 wherein the inorganic salt and the thickening agent are added to the reactor after the addition of all of the surfactants.
80. The continuous process of embodiment 77 wherein the water in the continuous reactor is maintained at a temperature in excess of 50° C.
81. The continuous process of embodiment 77 wherein a mixer selected from an inline mixer and a static mixer is present in the continuous reactor.
82. The continuous process of embodiment 77 wherein the continuous reactor is a tank or pipe of predetermined diameter and length.
83. A method of extinguishing a fire, comprising applying a composition comprising a composition of any of embodiment 1-74 to a fire, in an amount and time that are effective to extinguish the fire.

In addition, the present disclosure includes the following numbered embodiments, which are also exemplary only and not a limitation on the various embodiments of the present disclosure:

1) A composition comprising water and dissolved or suspended solids, the solids comprising a first surfactant selected from amphoteric surfactants, a second surfactant selected from anionic surfactants, and a third surfactant selected from an amphoteric and an anionic surfactant, the third surfactant being different from the first and second surfactants.

2) The composition of embodiment 1, wherein the first surfactant is a betaine surfactant, or in other words, is a surfactant that comprises a betaine group.
3) The composition of embodiment 1, wherein the first surfactant is an amido propyl betaine.
4) The composition of embodiment 3 wherein the amido propyl betaine is cocamido propyl betaine.
5) The composition of embodiment 3 wherein the amido propyl betaine is isostearyl propyl betaine.
6) The composition of embodiment 3 wherein the amido propyl betaine is lauramido propyl betaine.
7) The composition of embodiment 1 wherein the first surfactant is an amphoacetate surfactant.
8) The composition of embodiment 7 wherein the amphoacetate is the sodium salt of cocoamphoacetate.
9) The composition of embodiment 7 wherein the amphoacetate is the sodium salt of lauroamphoacetate.
10) The composition of embodiment 1 wherein the first surfactant is an amphopropionates surfactant.
11) The composition of embodiment 10 wherein the amphopropionate is the disodium salt of cocoamphodipropionate.
12) The composition of embodiment 10 wherein the amphopropionate is the sodium salt of capryloamphopropionate.
13) The composition of embodiment 1 wherein the first surfactant is a hydroxysultaine surfactant.
14) The composition of embodiment 13 wherein the hydroxysultaine is cocamidopropyl hydroxyl sultaine.
15) The composition of embodiment 13 wherein the hydroxysultaine is oleamidopropyl hydroxyl sultaine.
16) The composition of embodiment 13 wherein the hydroxysultaine is lauryl hydroxyl sultaine.
17) The composition of embodiment 1 wherein the first surfactant is an amine oxide surfactant.
18) The composition of embodiment 17 wherein the amine oxide is cocamidopropylamine oxide.
19) The composition of embodiment 17 wherein the amine oxide is N,N-(dihydroxyethyl) myristamine oxide.
20) The composition of embodiment 1 wherein the first surfactant is an imidazoline derivative.
21) The composition of embodiment 20 wherein the imidazoline derivative is an am phoglycinate.
22) The composition of each of embodiments 1-21 wherein the second surfactant is a sulfonate surfactant, or in other words, the second surfactant comprises a sulfonate group.
23) The composition of embodiment 22 wherein the sulfonate is the sodium salt of a linear dodecylbenzene sulfonate.
24) The composition of embodiment 22 wherein the sulfonate is the sodium salt of a $C_{14}$-$C_{16}$ olefin sulfonate.
25) The composition of embodiment 22 wherein the sulfonate is the sodium salt of a branched dodecylbenzene sulfonate.
26) The composition of embodiment 22 wherein the sulfonate salt is the triethanolamine salt of a linear or branched dodecylbenzene sulfonate.
27) The composition of embodiment 22 wherein the sulfonate salt is the isopropylamine salt of linear or branched dodecylbenzene sulfonate.
28) The composition of each of embodiments 1-21 wherein the second surfactant is a sulfate, or in other words, the second surfactant comprise a sulfate group.
29) The composition of embodiment 28 wherein the sulfate is a sodium salt of lauryl ether sulfate.
30) The composition of embodiment 28 wherein the sulfate is an ammonium salt of lauryl sulfate.
31) The composition of embodiment 28 wherein the sulfate is sodium octyl sulfate.
32) The composition of embodiment 28 wherein the sulfate is sodium dodecyl sulfate.
33) The composition of embodiment 28 wherein the sulfate is a sodium salt of an ethoxylated $C_6$-$C_{12}$ alcohol.
34) The composition of claim 28 wherein the sulfate is sodium laureth sulfate.
35) The composition of embodiment 28 wherein the sulfate is $C_{12}$-$C_{14}$ tert-alkyl-ethoxylated sodium sulfate.
36) The composition of each of embodiments 1-21 wherein the second surfactant is a sulfoacetate surfactant.
37) The composition of embodiment 36 wherein the sulfoacetate is the sodium salt of lauryl sulfoacetate.
38) The composition of embodiment 36 wherein the sulfoacetate is the ammonium salt of cetyl sulfoacetate.
39) The composition of each of embodiments 1-21 wherein the second surfactant is a phosphate surfactant selected from monoester and diester phosphate surfactants.
40) The composition of embodiment 39 wherein the phosphate is polyoxyethylene (10) nonylphenol phosphate.
41) The composition of embodiment 39 wherein the phosphate is the sodium salt of $C_8H_{17}$ phosphate.
42) The composition of each of embodiments 1-21 wherein the second surfactant is a sulfosuccinate surfactant.
43) The composition of embodiment 42 wherein the sulfosuccinate is sodium dioctyl sulfosuccinate.
44) The composition of embodiment 42 wherein the sulfosuccinate is disodium laureth sulfosuccinate.
45) The composition of each of embodiments 1-21 wherein the second surfactant is a carboxylate.
46) The composition of embodiment 45 wherein the carboxylate is a sodium salt of polyoxyethylene (8) octyl ether carboxylic acid.
47) The composition of embodiment 45 wherein the carboxylate is sodium salt of stearic acid.
48) The composition of each of embodiments 1-21 wherein the second surfactant is a sarcosinate.
49) The composition of embodiment 48 wherein the sarcosinate is sodium lauroyl sarcosinate.
50) The composition of embodiment 48 wherein the sarcosinate is ammonium cocoyl sarcosinate.
51) The composition of each of embodiments 1-21 wherein the second surfactant is a diphenyl oxide surfactant.
52) The composition of embodiment 51 wherein the diphenyl oxide is disulfonated diphenyl oxide with linear decyl substitution, sodium salt.
53) The composition of embodiment 51 wherein the diphenyl oxide is disulfonated diphenyl oxide with branched dodecyl substitution.
54) The composition of each of embodiments 1-53 wherein the third surfactant is an anionic surfactant.
55) The composition of embodiment 54 wherein the second and third surfactants are non-identical and are each selected from the group of sulfonate containing surfactants, sulfate containing surfactants, sulfoacetate containing surfactants, phosphate containing surfactants, sulfosuccinate containing surfactants, carboxylate containing surfactants, sarcosinate containing surfactants, and diphenyl oxide containing surfactants.

56) The composition of embodiment 1 wherein the first surfactant comprises a betaine, the second surfactant comprises a sulfonate, and the third surfactant comprises a sulfate.

57) The composition of embodiment 56 wherein the first surfactant is an amido propyl betaine surfactant, optionally cocamidopropyl betaine, the second surfactant is an alkylaryl sulfonate surfactant, optionally a salt of dodecylbenzene sulfonate, and the third surfactant comprises a sulfate surfactant, optionally selected from salts of laureth sulfate, octyl sulfate and dodecyl sulfate.

58) The composition of embodiment 1 wherein the first surfactant comprises an amphoacetate, the second surfactant comprises a sulfonate, and the third surfactant comprises a sulfate.

59) The composition of embodiment 1 wherein the first surfactant comprises hydroxysultaine, the second surfactant comprises sulfoacetate and the third surfactant comprises sulfate.

60) The composition of embodiment 1 wherein the first surfactant comprises amphodipropionate, the second surfactant comprises phosphate, and the third surfactant comprises sulfosuccinate.

61) The composition of embodiment 1 wherein the first surfactant comprises amine oxide, the second surfactant comprises carboxylic acid and the third surfactant comprises sarcosinate.

62) The composition of embodiment 1 wherein the first surfactant comprises betaine, the second surfactant comprises carboxylate, and the third surfactant comprises disulfonated diphenyl oxide.

63) The composition of each of embodiments 54-62 further comprising an inorganic salt, a thickening agent and an organic solvent selected from glycol monoethers and glycol diethers.

64) The composition of each of embodiments 1-53 wherein the third surfactant is an amphoteric surfactant.

65) The composition of embodiment 64, wherein the third surfactant is an amido propyl betaine amphoteric surfactant.

66) The composition of any one of embodiments 1-3 and 5-53 wherein the third surfactant is cocamido propyl betaine.

67) The composition of any one of embodiments 1-4 and 6-53 wherein the third surfactant is isostearyl propyl betaine.

68) The composition of any one of embodiments 1-5 and 7-53 wherein the third surfactant is lauramido propyl betaine.

69) The composition of any one of embodiments 1-53 wherein the third surfactant is an amphoacetate amphoteric surfactant.

70) The composition of any one of embodiments 1-7 and 9-53 wherein the third surfactant is the sodium salt of cocoamphoacetate.

71) The composition of any one of embodiments 1-8 and 10-53 wherein the third surfactant is the sodium salt of lauroamphoacetate.

72) The composition of any one of embodiments 1-53 wherein the third surfactant is an amphopropionate amphoteric surfactant.

73) The composition of any one of embodiments 1-10 and 12-53 wherein the third surfactant is the disodium salt of cocoamphodipropionate.

74) The composition of any one of embodiments 1-11 and 13-53 wherein the third surfactant is the sodium salt of capryloamphopropionate.

75) The composition of any one of embodiments 1-53 wherein the third surfactant is a hydroxysultaine amphoteric surfactant.

76) The composition of any one of embodiments 1-13 and 15-53 wherein the third surfactant is cocamidopropyl hydroxyl sultaine.

77) The composition of any one of embodiments 1-14 and 16-53 wherein the third surfactant is oleamidopropyl hydroxyl sultaine.

78) The composition of any one of embodiments 1-15 and 17-53 wherein the third surfactant is lauryl hydroxyl sultaine.

79) The composition of any one of embodiments 1-53 wherein the third surfactant is an amine oxide amphoteric surfactant.

80) The composition of any one of embodiments 1-17 and 19-53 wherein the third surfactant is cocamidopropylamine oxide.

81) The composition of any one of embodiments 1-18 and 20-53 wherein the third surfactant is N,N-(dihydroxyethyl) myristamine oxide.

82) The composition of any one of embodiments 1-53 wherein the third surfactant is an imidazoline derivative amphoteric surfactant.

83) The composition of any one of embodiments 1-53 wherein the third surfactant is an amphoglycinate amphoteric surfactant.

84) The composition of any one of embodiments 1-53 wherein the third surfactant is a sulfonate containing anionic surfactant.

85) The composition of any one of embodiments 1-22 and 24-53 wherein the third surfactant is the sodium salt of a linear dodecylbenzene sulfonate.

86) The composition of any one of embodiments 1-23 and 25-53 wherein the third surfactant is the sodium salt of a $C_{14}$-$C_{16}$ olefin sulfonate.

87) The composition of any one of embodiments 1-24 and 26-53 wherein the third surfactant is the sodium salt of a branched dodecylbenzene sulfonate.

88) The composition of any one of embodiments 1-25 and 27-53 wherein the third surfactant is the triethanolamine salt of a linear or branched dodecylbenzene sulfonate.

89) The composition of any one of embodiments 1-26 and 28-53 wherein the third surfactant is the isopropylamine salt of linear or branched dodecylbenzene sulfonate.

90) The composition of any one of embodiments 1-53 wherein the third surfactant is a sulfate anionic surfactant.

91) The composition of any one of embodiments 1-28 and 30-53 wherein the third surfactant is the sodium salt of lauryl ether sulfate.

92) The composition of any one of embodiments 1-29 and 31-53 wherein the third surfactant is the ammonium salt of lauryl sulfate.

93) The composition of any one of embodiments 1-34 and 36-53 wherein the third surfactant is $C_{12}$-$C_{14}$ tert-alkyl-ethoxylated sodium sulfate.

94) The composition of any one of embodiments 1-53 wherein the third surfactant is a sulfoacetate anionic surfactant.

95) The composition of any one of embodiments 1-36 and 38-53 wherein the third surfactant is the sodium salt of lauryl sulfoacetate.

96) The composition of any one of embodiments 1-37 and 39-53 wherein the third surfactant is the ammonium salt of cetyl sulfoacetate.

97) The composition of any one of embodiments 1-53 wherein the third surfactant is a phosphate anionic surfactant selected from monoester and diester phosphate surfactants.

98) The composition of any one of embodiments 1-39 and 41-53 wherein the third surfactant is polyoxyethylene (10) nonylphenol phosphate.

99) The composition of any one of embodiments 1-40 and 42-53 wherein the third surfactant is the sodium salt of $C_8H_{17}$ phosphate.

100) The composition of any one of embodiments 1-53 wherein the third surfactant is a sulfosuccinate anionic surfactant.

101) The composition of any one of embodiments 1-42 and 43-53 wherein the third surfactant is sodium dioctyl sulfosuccinate.

102) The composition of any one of embodiments 1-43 and 44-53 wherein the third surfactant is disodium laureth sulfosuccinate.

103) The composition of any one of embodiments 1-53 wherein the third surfactant is a carboxylate anionic surfactant.

104) The composition of any one of embodiments 1-45 and 47-53 wherein the third surfactant is a sodium salt of polyoxyethylene (8) octyl ether carboxylic acid.

105) The composition of any one of embodiments 1-46 and 48-53 wherein the third surfactant is sodium salt of stearic acid.

106) The composition of any one of embodiments 1-53 wherein the third surfactant is a sarcosinate anionic surfactant.

107) The composition of any one of embodiments 1-48 and 50-53 wherein the third surfactant is sodium lauroyl sarcosinate.

108) The composition of any one of embodiments 1-49 and 51-53 wherein the third surfactant is ammonium cocoyl sarcosinate.

109) The composition of any one of embodiments 1-53 wherein the third surfactant is a diphenyl oxide anionic surfactant.

110) The composition of any one of embodiments 1-51 and 53 wherein the third surfactant is disulfonated diphenyl oxide with linear decyl substitution, sodium salt.

111) The composition of any one of embodiments 1-52 wherein the third surfactant is disulfonated diphenyl oxide with branched dodecyl substitution.

112) The composition of any of the preceding embodiments, wherein amphoteric surfactant(s) comprise 10-30 wt % of the weight of the solids.

113) The composition of any of the preceding embodiments, wherein amphoteric surfactant(s) comprise 10-15 wt % of the weight of the solids.

114) The composition of any of the preceding embodiments, wherein amphoteric surfactant(s) comprise 15-20 wt % of the weight of the solids.

115) The composition of any of the preceding embodiments, wherein amphoteric surfactant(s) comprise 20-25 wt % of the weight of the solids.

116) The composition of any of the preceding embodiments, wherein amphoteric surfactant(s) comprise 15-25 wt % of the weight of the solids.

117) The composition of any of the preceding embodiments, wherein anionic surfactant(s) comprise 45-85 wt % of the weight of the solids.

118) The composition of any of the preceding embodiments, wherein anionic surfactant(s) comprise 45-85 wt % of the weight of the solids.

119) The composition of any of the preceding embodiments, wherein anionic surfactant(s) comprise 45-55 wt % of the weight of the solids.

120) The composition of any of the preceding embodiments, wherein anionic surfactant(s) comprise 55-65 wt % of the weight of the solids.

121) The composition of any of the preceding embodiments, wherein anionic surfactant(s) comprise 65-75 wt % of the weight of the solids.

122) The composition of any of the preceding embodiments, wherein anionic surfactant(s) comprise 75-85 wt % of the weight of the solids.

123) The composition of any of the preceding embodiments, wherein the water comprises 75-95 wt % of the composition.

124) The composition of any of the preceding embodiments, wherein the water comprises 75-80 wt % of the composition.

125) The composition of any of the preceding embodiments, wherein the water comprises 80-85 wt % of the composition.

126) The composition of any of the preceding embodiments, wherein the water comprises 85-90 wt % of the composition.

127) The composition of any of the preceding embodiments, wherein the water comprises 90-95 wt % of the composition 128) The composition of any of the preceding embodiments, further comprising an inorganic salt.

129) The composition of embodiment 128 wherein the inorganic salt comprises 2 to 20 wt % of the solids.

130) The composition of embodiment 128 wherein the inorganic salt comprises 0.1 to 5.0 wt % of the composition 131) The composition of any one of embodiments 128-130, wherein the inorganic salt is one or more selected from alkaline aluminum oxalate, aluminum ammonium sulfate, aluminum borate whisker, aluminum dihydrogen phosphate, aluminum hydroxide, ammonium molybdate, aluminum phosphate, aluminum potassium sulfate, aluminum sulfate, ammonium heptamolybdate, ammonum octamolybdate, antimony trioxide, barium metaborate, barium sulfate, basic copper carbonate, basic zinc carbonate, beryllium carbonate, bismuth hydroxide, calcium carbonate, calcium chloride, calcium hydrogen phosphate, cerium hydroxide, cerous carbonate, chromium carbonate, cobalt hydroxide, cobaltous carbonate, dimanganese hydrogen phosphate, disodium hydrogen phosphate, di-zinc hydrogen phosphate, dolomite (calcium magnesiuim bicarbonate), dysprosium carbonate, erbium carbonate, europium carbonate, ferric hydroxide, ferrocene, ferric acetone, ferric oxide, ferroferric oxide, ferrous ammonium sulfate, ferrous carbonate, gadolinium carbonate, guanidine carbonate, holmium carbonate, hydrogen phosphate metaborate strontium, hydrogen phosphate strontium metaborate potassium, hydromagnesite, iron nitride, lanthanum carbonate, lanthanum hydroxide, lithium carbonate, lutecium carbonate, magnesium ammonium phosphate, manganese borate, magnesium dihydrogen phosphate, magnesium hydrogen phosphate, magnesium hydrogen sulfate, magnesium hydroxide, magnesium metaborate hydrate, magnesium nitrate, magnesium trisilicate, manganese carbonate, manganese citrate, manganese dihydrogen phosphate, manganese oxalate dihydrate, manganese phosphate, manganese tungstate, manganite, molybdenum hydroxide, monocalcium phosphate, monopotassium phosphate, neodymium carbonate, nickel carbonate, nickel oxalate, potassium bicarbonate, potassium hexafluorotitanate, potassium hexafluoro zirconate, potassium meta phosphate, potassium nitrate, potassium oxalate, potassium sodium carbonate hexahydrate, potassium tetra borate hydrate, potassium tripolyphosphate, praseodymium carbonate, samarium carbonate, scandium carbonate, silver carbonate, sodium bicarbonate, sodium citrate, sodium dihydrogen phosphate, sodium nitrate, sodium oxalate, sodium sesquicarbonate, sodium trimetaphosphate, sodium tungstate, strontium carbonate, strontium hydroxide, strontium meta borate, strontium tetraborate, strontium tetraborate hydrate, telluric acid, terbium carbonate, thulium carbonate, tin oxide, titanium dioxide, vanadium carbonate, ytterbium carbonate, yttrium carbonate, zinc oxide, zinc sulfide, zinc sulfate heptahydrate, zinc borate, zinc carbonate, zinc dihydrogen phosphate, zinc phosphate, zinc stannate, zirconium carbonate, and zirconium nitrate.

132) The composition of any one of embodiments 128-130, wherein the inorganic salt is calcium chloride.

133) The composition of any of the preceding embodiments, further comprising an aqueous thickening agent.

134) The composition of embodiment 133 wherein the thickening agent comprises 0.1 to 5 wt % of the solids.

135) The composition of embodiment 133 wherein the thickening agent comprises 0.01 to 2 wt % of the composition.

136) The composition of embodiment 133 wherein the aqueous thickening agent is one or more thickener selected from a polyamide and a cellulosic.

137) The composition of embodiment 133 wherein the aqueous thickening agent is selected from a carboxy methyl cellulose and a hydroxyethylcellulose.

138) A batch process for making a fire extinguishing concentrated composition comprising adding to a container, hot water, a first anionic surfactant, a second anionic surfactant, a third surfactant selected from an amphoteric surfactant and an anionic surfactant, wherein the third surfactant is different from the first surfactant and the second surfactant, and optionally adding an inorganic salt, and thickening agent; wherein after an addition of a component to the container, a resulting mixture is stirred for about 30 minutes with minimal foam generation before addition of a next component.

139) The batch process of embodiment 138 for making a fire extinguishing concentrate composition comprising: (a) heating water to about 70-80° C. to provide hot water; (b) adding a first anionic surfactant to the hot water; (c) adding a first amphoteric surfactant to the mixture of step b); (d) adding hot water to the mixture of step c); (e) adding a third surfactant to the mixture of step d), the third surfactant selected from an anionic surfactant and an amphoteric surfactant, the third surfactant being different from the first anionic surfactant and the first amphoteric surfactant; (f) adding inorganic salt to the mixture of step e); (g) cooling the mixture of step f) to within ±20° C. of ambient temperature; and (h) adding thickening agent to the mixture of step f); wherein after an addition of a component, a resulting mixture is stirred for about 30 minutes with minimal foam generation before addition of a next component.

140) A continuous process for making a fire extinguishing concentrated composition comprising providing a continuous reactor, charging water to the continuous reactor, continuously feeding to the continuous reactor a) an anionic surfactant, b) an amphoteric surfactant, and c) a third surfactant selected from an anionic surfactant and an amphoteric surfactant, the third surfactant being different from the anionic surfactant of step a) and the amphoteric surfactant of step b); and mixing components a), b) and c) to provide a homogeneous mixture.

141) The continuous process of embodiment 140 further comprising continuously feeding to the reactor inorganic salt and thickening agent.

142) The continuous process of embodiment 140 wherein the inorganic salt and the thickening agent are added to the reactor after the addition of all of the surfactants.

143) The continuous process of embodiment 140 wherein the water in the continuous reactor is maintained at a temperature in excess of 50° C.

144) The continuous process of embodiment 140 wherein a mixer selected from an inline mixer and a static mixer is present in the continuous reactor.

145) The continuous process of embodiment 140 wherein the continuous reactor is a tank or pipe of predetermined diameter and length.

146) A method of extinguishing a fire, comprising applying a composition comprising a composition of any of embodiment 1-145 to a fire, in an amount and time that are effective to extinguish the fire.

Any of the various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including but not limited to [insert list], are incorporated herein by reference, in their entirety. Aspects of the embodiments can be modified, if necessary to employ concepts of the various patents, applications and publications to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A composition comprising water and solids, the solids comprising a first surfactant selected from amphoteric betaine surfactants, a second surfactant selected from dodecylbenzene sulfonate surfactants, and a third surfactant is the sodium salt of lauryl ether sulfate, the composition further comprising calcium chloride and an aqueous thickening agent, where the composition does not contain a component having carbon-halogen bonds.

2. The composition of claim 1, wherein the first surfactant is an amido propyl betaine.

3. The composition of claim 2 wherein the amido propyl betaine is cocamido propyl betaine.

4. The composition of claim 1 wherein the sulfonate is the sodium salt of a linear dodecylbenzene sulfonate.

5. The composition of claim 1 wherein the sulfonate is the sodium salt of a branched dodecylbenzene sulfonate.

6. The composition of claim 1, wherein the amphoteric betaine surfactant(s) comprise 10-30 wt % of the weight of the solids.

7. The composition of claim 1, wherein anionic surfactant(s) comprise 45-85 wt % of the weight of the solids.

8. The composition of claim 1, wherein the water comprises 75-95 wt % of the composition.

9. The composition of claim 1 wherein the calcium chloride comprises 2 to 20 wt % of the solids.

10. The composition of claim 1 wherein the thickening agent comprises 0.01 to 2 wt % of the composition.

11. The composition of claim 1 wherein the aqueous thickening agent is one or more thickener selected from a polyamide and a cellulosic.

* * * * *